US007582009B1

(12) United States Patent
Côté

(10) Patent No.: US 7,582,009 B1
(45) Date of Patent: Sep. 1, 2009

(54) ADJUSTABLE AIR VOLUME REGULATOR FOR HEATING, VENTILATING AND AIR CONDITIONING SYSTEMS

(76) Inventor: Anthony J. Côté, 884 Montée Ste-Thérèse, Prévost, Québec (CA) J0R 1T0

( * ) Notice: Subject to any disclaimer, the term of this patent is extended or adjusted under 35 U.S.C. 154(b) by 290 days.

(21) Appl. No.: 11/342,384

(22) Filed: Jan. 27, 2006

Related U.S. Application Data

(60) Provisional application No. 60/651,361, filed on Feb. 10, 2005.

(51) Int. Cl.
*F24F 7/00* (2006.01)

(52) U.S. Cl. ..... 454/264; 454/266; 454/267

(58) Field of Classification Search ..... 454/264, 454/186

See application file for complete search history.

(56) References Cited

U.S. PATENT DOCUMENTS

| | | | | |
|---|---|---|---|---|
| 2,890,716 | A | | 6/1959 | Werder |
| 3,060,960 | A | | 10/1962 | Waterfill |
| 3,276,480 | A | | 10/1966 | Kennedy |
| 3,425,443 | A | | 2/1969 | Smith |
| 3,939,868 | A | | 2/1976 | Logsdon |
| 3,942,552 | A | | 3/1976 | Logsdon |
| 3,958,605 | A | | 5/1976 | Nishizu et al. |
| 3,967,642 | A | | 7/1976 | Logsdon |
| 4,090,434 | A | * | 5/1978 | Krisko et al. ..... 454/264 |
| 4,130,132 | A | | 12/1978 | Côté |
| 4,231,253 | A | * | 11/1980 | Ohnhaus et al. ..... 73/861.62 |
| 4,387,685 | A | * | 6/1983 | Abbey ..... 123/439 |
| 4,633,900 | A | | 1/1987 | Suzuki |
| 4,807,667 | A | * | 2/1989 | Ohnhaus ..... 138/45 |
| 5,251,654 | A | * | 10/1993 | Palmer ..... 137/501 |

* cited by examiner

*Primary Examiner*—Steven B. McAllister
*Assistant Examiner*—Samantha Miller

(57) ABSTRACT

An improved air volume regulator used in HVAC operating at a static pressure below 25 pa. (0.1"w.g.) having a pair of opposing gates facing into the airflow and a V shaped baffle positioned to form two constricting passageways. Air flowing through the passageway generates a light vacuum at its throat and combined with the static pressure differential across the gates urges them towards the baffle and constricts the airflow. A counterbalance spring cooperating with a concave cam and cam follower applies a resisting bias on gates such that the airflow in the regulator remains constant under varying inlet conditions. A variable spring rate mechanism permits the adjustment of the airflow rate over the full operating range using a single counterbalance spring. A cable driven "limited torque" flywheel controls the air volume regulator's propensity to pulsate under unstable inlet airflow conditions.

12 Claims, 18 Drawing Sheets

ADJUSTABLE AIR VOLUME REGULATOR FOR HEATING, VENTILATING AND AIR CONDITIONING SYSTEMS

CROSS-REFERENCE TO RELATED APPLICATIONS

This application claims the benefit of PPA Ser. No. 60/651,361 filed Feb. 10, 2005

FEDERALLY SPONSORED RESEARCH

Not applicable

SEQUENCE LISTING OF PROGRAM

Not applicable

BACKGROUND OF THE INVENTION

1. Field of Invention

This invention relates to an air volume regulator, more specifically to an improved "airflow powered" air volume regulator as used to control the flow of conditioned air in the ductwork of heating, ventilating and air conditioning (HVAC) systems, clean rooms or fume hood systems.

2. Background of the Invention

In HVAC systems, air is supplied from a central air conditioning system to several outlet devices such as grilles and diffusers in the rooms or spaces being conditioned. Once a HVAC system is installed, the airflow through the ductwork system must be adjusted or balanced. This insures that each room or space obtains the specified volumes of conditioned air from the central system. In its simplest form, this can be done by using manually adjustable dampers. They are placed within the supply air and return air ductwork to reduce the airflow in areas where it exceeds the specified amount. There is an inherent problem with this method. When one damper is adjusted, the pressure level throughout the ductwork system will change. Any change in the ductwork system pressure will affect the flow or air past every other damper including the previously adjusted dampers. On large systems, it quickly becomes impractical to attempt to balance the ductwork system using dampers alone. To solve this problem, air volume regulators are added. They are designed to limit the supply of conditioned air to the desired amount and this, irregardless of the pressure at their inlet. Also, once calibrated, the airflow is not affected by subsequent variations in system pressure. The accepted industry standard airflow variation is +/−5% of the specified airflow volume (4.7 L/s below 94 L/s or 10 cfm below 200 cfm) over the airflow regulator's pressure range.

Furthermore, heating, cooling and ventilating loads in a room or space vary in time. It has become common practice to stabilize the temperature of the rooms or spaces by:

(a) varying the volume of conditioned air supplied to each room or space or (b) using heating coils downstream from the air volume regulator to heat the volume of cool conditioned air being supplied to the room or space or (c) using a dual ductwork layout for the HVAC system known as dual-duct system: one supplying hot air, the second supplying cool air and a mixing valve upstream of the air volume regulator or (d) using combinations of the above.

Air volume regulators fall into one of two general groups based on the source of energy that is used to drive them: "airflow powered" and "externally powered".

"Airflow powered" air volume regulators function using the energy of the air flowing in the ductwork system. This source of energy is in the form of air static pressure and air velocity pressure (called dynamic pressure). The scope of this invention is limited to improved "airflow powered" air volume regulators.

Briefly, "externally powered" air volume regulators operate using an external energy source such as pneumatic pressure or electricity. They require an airflow sensor, a signal amplifier, an actuator and an adjustable airflow restricting device or damper to regulate the flow of air.

As mentioned above, the energy source used to drive the "airflow powered" air volume regulator comes from two types of pressure present in HVAC systems: static pressure and dynamic pressure. The static pressure induces the movement of the air through the ductwork towards the outlets while the dynamic or velocity pressure is generated by the movement of the air at a given point within the ductwork. The higher the air velocity the greater the dynamic pressure.

The flow of air through the ductwork of an HVAC system is governed by the following basic formulas:

No. 1: The relationship between air velocity and dynamic pressure is given by the following $$P_d = \text{Dynamic Pressure} = \text{Constant} \times (V_a)^2$$

No. 2: The sum of the static pressure and dynamic pressure is called the total pressure:

$$P_t = P_s + P_d$$

No. 3: The airflow rate is equal to the air velocity times the area of the duct cross section.

$$Q_a = V_a \times A_{duct}$$

where $Q_a$=Air volume rate $V_a$=air velocity $A_{duct}$=area of the duct cross section A conclusion of formula no. 2 is that, under the idealized conditions of constant total pressure (i.e. no losses due to friction and turbulence), the static pressure and dynamic pressure can be converted from one to the other. A decrease of one entails an equal increase of the other.

A conclusion of formula no. 3 is that, for a constant volume flow, an increase in the duct cross section entails a proportional decrease in the air velocity. Conversely, a decrease in the duct cross-section entails a proportional increase in the air velocity.

Combining the 3 formulas, we can conclude that, for a constant total pressure (i.e. no losses due to friction and turbulence):

- an increase in the duct cross section means
  - a decrease in dynamic pressure (associated with a decrease in air velocity)
  - an equal increase in static pressure. This is known as "static regain".
- a decrease in the duct cross section means
  - an increase in dynamic pressure (again associated to the air velocity) and
  - an equal decrease in static pressure.

3. Background of the Invention—Discussion of Prior Art

A—INTERACTION WITH THE HVAC SYSTEM

As stated above, an air volume regulator is required when the airflow rate in the ductwork system exceed the desired amount. This happens when more static pressure is present in the air duct than is required to move the air to the outlet devices. Although all air volume regulators inherently create a pressure loss due to air friction and air turbulence as the air flows through them, prior art "airflow powered" air volume regulator also requires some amount of pressure to drive the flow control means. The sum of these pressure losses is called the regulator minimum static pressure. Under most conditions, this extra control pressure required to drive the flow control means is of little consequence. Excess pressure is usually present at the inlet of the air volume regulator. In the cases where the air volume regulator is installed in a area with little or no excess static pressure (i.e. at the far limits of the central air distribution system), the control pressure requirement may be greater than the available excess pressure. Consequently, the air volume regulator will be incapable of controlling the airflow and the desired airflow rate will not be attained. Thus a desirable characteristics of an air volume regulator is that it have a negligible pressure loss due to air friction and turbulence and more important still, require virtually no static pressure to bring the flow of air under control. Although many forms of prior art have been proposed, none have met this challenge.

B—OPERATION

An air volume regulator functions by varying its internal airflow passageway(s) so as to maintain a substantially constant airflow rate. In "airflow powered" air volume regulators, the air pressure and velocity drive some form of airflow restricting means. A spring is then used to counterbalance the forces acting on the restricting means (called the counterbalance spring).

The graph in FIG. 1 shows, for a constant flow of air, the variation in the cross sectional area of the narrowest portion or throat of the airflow passageway as the static pressure differential across the air volume regulator increases from 25 pascals to 1000 pascals (0.1" to 4" w.g).

The graph in FIG. 1 is derived from the following:

(a) with the throat open to its maximum, the static pressure drop is 25 pascals (0.1" w.g.); this pressure is mainly to drive the flow control means and frictional loses due to turbulence, (b) the variation in the area of the throat is inversely proportional to the air velocity at the throat, i.e. if the velocity goes up, the area must go down proportionally, a corollary of formula 3 above, (c) the static pressure differential or static pressure drop between the inlet and outlet of the air passageway is substantially converted to dynamic pressure in the throat of the passageway. This assumes that the total pressure remains substantially constant (negligible loses due to friction or turbulence)

(d) in the throat, the static pressure drop is proportional to the square of velocity at that point (the drop in static pressure is totally converted to dynamic pressure) i.e. if the static pressure drop doubles, the velocity in the throat will quadruple.

Combining the three previous statements, an exponential equation is obtained:

$$\text{Area} = \frac{\text{constant}}{\sqrt{\text{static pressure drop}}}$$

where the constant depends on the air volume regulator design.

FIG. 1 is a graph of this exponential equation. The cross-sectional area of the throat must drop quickly as the pressure differential rises. It then starts to level off to a point were very little reduction of the throat is required to control the airflow (approximately 500 pascals or 2" w.g.). Also, as the pressure differential rises from 25 pascals to 125 pascals (0.1" to 0.5" w.g.), the area of the throat must be reduced by over 50%. Furthermore, since the air volume regulator contains moving parts, mechanical friction is present and this inhibits the reduction of the throat. Thus to operate reliably, the airflow regulator must be capable of initiating and maintaining control of the airflow using and/or amplifying the very low forces generated by these low pressures. I have found no prior art that proposes an "airflow powered" air volume regulator with this latter capability.

The sum of all mechanical friction in an airflow regulator generates an adverse effect on its operation. This can be visualized by drawing an hysteresis graph: a graph is plotted of the airflow rate versus inlet pressure as the pressure is slowly increased up to the upper limit of the airflow regulator's pressure range then, on the same graph, is plotted the airflow rate versus inlet pressure as the pressure is slowly decreased down to the lower limit of the pressure range. The two curves do not coincide with one another. The reason for this is that as the pressure increases, the air velocity increases and the airflow regulator tends to reduce the airflow passageways so as to maintain the specified airflow rate. But mechanical friction within it tends to resist this reduction and the correct passageway size is not attained. The airflow passageways are consequently a little to wide and thus the airflow rate will be slightly above the specified airflow rate. Conversely, as the pressure decreases from the upper limit of the pressure range, the air velocity decreases and the airflow regulator tends to increase the airflow passageways so as to maintain the desired airflow rate. Again mechanical friction within it tends to resist this increase. The airflow passageways are consequently a little to narrow and thus the airflow rate will be slightly below the specified airflow rate. The more mechanical friction is found in an airflow regulator, the greater the difference between the specified airflow rate and the actual airflow rate. As outlined above, this difference must not exceed 5% of the specified airflow rate.

In practice, attempts made in commercially available prior art to reduce the regulator minimum static pressure below 100 pascals (0.3" w.g.) for "airflow powered" units have been unsuccessful. In referring to U.S. Patents such as 3,049,146 to Hayes (1962), 2,890,716 to Werder (1959), 3,338,265 to Kennedy (1967) and 4,009,826 to Walker (1977), forcing the airflow to pass through perforated screens has a particularly adverse effect on the regulator minimum static pressure (this generates high airflow friction and turbulence losses). As mentioned above, particular attention must be paid to mechanical friction in the moving parts of the air volume regulator. All prior art embodiments using components sliding on shafts encounter, over time, binding of some kind when dirt particles get lodged in the sliding bearing. This is the case with U.S. Pat. Nos. 3,204,664 to Gorchev et al. (1965), 3,763,884 to Grassi et al. (1973), 3,958,605 to Nishizu et al. (1976) and 4,009,826 to Walker (1977). Adding lubricant does not improve this inconvenience since again, over time, the lubricant attracts dirt particles to form a abrasive paste that resists movement.

C—COUNTERBALANCE SPRING

The air volume regulator should include a means to easily vary the desired airflow rate's setpoint at will once installed in the ductwork system. This is made necessary by changing conditions such as occupancy of the areas, insolation and outside temperature. It is common practice to add an optional actuator to adjust the setpoint mechanism and control it remotely. As noted above, a spring is used to counterbalance the forces acting on the flow restricting means. As stated in U.S. Pat. Nos. 4,306,585 to Manos (1981), 4,009,826 to Walker (1977), 3,958,605 to Nishizu (1976), 3,942,552 and 3,939,868 to Logsdon (1976), 3,763,884 to Grassi et al. (1973), 3,565,105 to Murakami (1971) and 3,037,528 to Baars et al. (1962), varying the initial load of the counterbalance spring by adjusting the initial spring deflection is only effective for small variations in the airflow setpoint. As stated in these patents, the spring quickly become either to stiff or to soft and the air volume regulator ceases to adequately control the airflow. Although not stated in the following patents, I also believe this to be true for U.S. Pat. Nos. 4,633,900 to Suzuki (1987), 3,967,642 to Logsdon (1976), 3,433,410 to Warren (1969), the embodiment in FIG. 7 of 3,276,480 to Kennedy (1966), 3,204,664 to Gorchev et al. (1965), 3,049,146 to Hayes (1962) and 2,890,716 to Werder (1959). Thus for a particular air volume regulator at a given flow rate corresponds a spring stiffness known as its spring rate or spring constant and is defined as the force generated divided by the spring deflection. In general terms, the spring rate is the "force-displacement" characteristic of the spring. To vary the airflow setpoint requires that the spring stiffness be varied or several springs be used over the operating range of the regulator. As shown in U.S. Pat. Nos. 4,009,826 to Walker (1977), 3,939,868 (1976) and 3,942,552 (1976) to Logsdon and my own U.S. Pat. No. 4,130,132 (1978), relatively complex mechanisms are proposed to vary the spring stiffness.

D—ACTUATORS

As mentioned above, an actuator may be used to action the flow rate setpoint mechanism. The control signal to the actuator is generally supplied by a thermostat. Actuators may be either pneumatic or electric driven. But pneumatic actuators can be a problem when the flow restricting forces applied to the counterbalance spring are also carried by the actuator. Pneumatic actuators have an inherent load dependant stroke or travel due to the compressibility of the air pushing the actuator's piston. Since the flow restricting forces vary in time due to changes in the static pressure upstream from the air volume regulator, so does the load on the counterbalance spring and thus the actuator. The pneumatic actuator's piston will move or slip under the varying load with the ensuing unjustified change in the flow rate setpoint. This phenomena is clearly outlined in the report "Factors that work to defeat the application of the "spring and cone" type valves in laboratory and other precision airflow systems" by Swiki A. Anderson, Ph.D., P. E., (Swiki Anderson & Associates, Inc. 1516 Shiloh Avenue, Bryan, Tex. 77803). The thermostat will sense a variation in the temperature of the room caused by the change in the flow rate and adjust the pressure to the pneumatic actuator to rectify the unjustified change and its ensuing discomfort to the occupants. This is the case in U.S. Pat. Nos. 4,633,900 to Suzuki (1987), 4,175,583 to Finkelstein et al. (1979), 3,958,605 to Nishizu et al. (1976), 3,942,552 to Logsdon (1976), 3,204,664 to Gorchev (1965) and my own U.S. Pat. No. 4,130,132 (1978).

Further concerns involving the actuator are:

To facilitate field servicing and repairs, the actuator should not be situated inside the air volume regulator or its housing such as U.S. Pat. Nos. 3,976,244, 3,942,552 and 3,939,868 to Logsdon (1976) and my own U.S. Pat. No. 4,130,132 (1978)

Its replacement should not affect the calibration of the air volume regulator such as my own U.S. Pat. No. 4,130, 132 (1978).

E—ZERO FLOW

When an actuator is used to vary the flow rate set point and under certain conditions, it is common practice in HVAC systems to restrict the flow completely (substantially zero flow is the accepted industry standard leakage of 2% of the maximum airflow capacity at the maximum operating pressure of the regulator). The flow restricting means must then be able to block the flow of air through the air volume regulator. In prior art, this is not possible with U.S. Pat. No. 3,958,605 to Nishizu et al. (1976), U.S. Pat. No. 4,009,826 to Walker (1977) or U.S. Pat. No. 4,633,900 to Suzuki (1987) because of leakage at edges of the flow restricting plates. Furthermore, this is not possible with U.S. Pat. Nos. 3,942,552 or 3,939,868 to Logsdon (1976) because the counterbalance spring never totally releases the flow restricting means or with U.S. Pat. No. 4,009,826 to Walker (1977) and U.S. Pat. No. 3,204,664 to Gorchev (1965) because of leakage at the edges of their sliding flow restrictors.

F—PULSATION

A phenomena that is well known in prior art and unique to "airflow powered" air volume regulators is their propensity to flutter, oscillate or pulsate when the air stream at their inlet is unstable. This inherent characteristic is due to the use of a spring to counterbalance the airflow restricting forces within the air volume regulator. Variations in the pressure upstream from the air volume regulator caused by turbulence or other instabilities can induce pressure pulses that travel down the ductwork to the air volume regulator. These fluctuations induce a rapid rise and fall in pressure usually lasting less than a second. If the amplitude of the pressure pulse is significant, the air volume regulator will react rapidly to constrict the airflow passage on sensing the rise in pressure then open the airflow passage on sensing the drop in pressure. But the inertia of the apparatus is such that the air volume regulator will tend to be out of phase with the quick change in pressure: over-constricting the airflow passage as the pressure starts to return to normal or under-constricting the airflow passage once the pressure has returned to its initial level. This out of phased reaction sets in motion the pulsation, as the spring-inertia combination oscillates between extremes driven by the energy of the air upstream of the apparatus as a car with defective shock absorbers when it hits a bump in the road. Dampening means must then be included to brake the cycle.

In prior art, U.S. Pat. No. 3,276,480 Kennedy (1966) and U.S. Pat. No. 3,763,884 to Grassi et al. (1973) employ dashpots and U.S. Pat. No. 3,049,146 to Hayes proposes a wear plate but their inherent friction hinders the airflow tracking of the air volume regulator and creates an unacceptably large hysteresis in its control. It is to be noted again that all mechanical friction within the apparatus prevents it from operating at low pressures. U.S. Pat. No. 3,204,664 to Gorchev (1965) teaches an air bellows with a flow orifice but the entrapped air is compressible and acts like a spring (air spring). The addition of mass to create inertia such as flywheels is shown in U.S. Pat. No. 3,060,960 to Waterfill (1962), but this method only lowers the natural frequency of the spring-mass combination: pulsation can still occur but at a lower frequency. The only true dampening that will dissipate the energy is due to the mechanical friction of this device. Under certain condition, I have found that the addition of inertia alone is ineffective.

In summary, the major drawbacks in prior art "airflow powered" air volume regulators are the following:

The minimum static pressure required by the air volume regulator to start controlling the airflow rate is relatively high. The long-felt need for an air volume regulator functioning reliably at pressures at or below 25 pascals (0.1" w.g.) is unsolved.

The means for varying the airflow rate setpoint remain relatively complex, ineffective or in some cases, none existent. In some prior art embodiments, the flow rate set point may "slide" when a pneumatic actuator is employed.

Most prior art embodiments cannot attain "zero flow" when an actuator is proposed to vary their flow rate setpoint.

They have a propensity to flutter, oscillate or pulsate when the airstream at their inlet is unstable. Dampening means are proposed but either generate excessive mechanical friction or, under certain conditions, are ineffective.

BACKGROUND OF THE INVENTION—OBJECTS AND ADVANTAGES

Accordingly, several objects and advantages of my invention are:

(a) To provide an "airflow powered" air volume regulator that reliably controls the airflow to within the "HVAC Industry Standard Variation" of +/−5% of specified airflow rate (or 4.7 L/s below 94 L/s) (or 10 cfm below 200 cfm) over its full airflow range.

(b) To provide an "airflow powered" air volume regulator that solves the long-felt need to initiate the control of the airflow at a pressure of 25 pascals (0.1" w.g.) or less over its full airflow range.

(c) To provide an air volume regulator requiring only one counterbalance spring to cover its full operating range.

(d) To provide an air volume regulator whose setpoint will not "slide" when a pneumatic actuator is included to vary its airflow setpoint.

(e) To provide an air volume regulator that can substantially shut-off the airflow when an actuator is installed to vary its airflow setpoint.

(f) To provide an air volume regulator that will substantially control its propensity to flutter, oscillate or pulsate when the air stream at its inlet is unstable.

Other objects and advantages are:

(g) To provide an air volume regulator which, when combine with an optional actuator means to vary its airflow setpoint, requires at most 4 Nm (35 lbs-in) of torque with airflow rates as high as 944 L/s (2000 cfm).

(h) To provide an air volume regulator with few moving parts and substantially no mechanical friction between them.

(i) To provide an air volume regulator with its counterbalance spring and associated linkage removed from the airstream to eliminate the possibility of dirt particles within the airstream lodging in the pivot points of the moving parts and creating undesirable friction. This also permits servicing of the unit without shutting down the supply fan.

(j) To provide an air volume regulator which permits field adjustment from the exterior of the unit. When an actuator is required to vary its airflow setpoint, it is situated on the exterior of the air volume regulator and can be easily added or replaced in the field without requiring modifications or without affecting the air volume regulator's calibration.

Still further objects and advantages of my invention will become apparent from a consideration of the ensuing description and drawings.

SUMMARY

In accordance with the present invention, an air volume regulator that will maintain the flow of air moving through it substantially constant at inlet static pressures of 25 pascals (0.1" w.g.) or less. It comprises a pair of gates that swing into the airflow, a counterbalance spring assembly with an adjustable spring rate and a cable driven "limited torque" flywheel.

DRAWINGS—FIGURES

Figure 3A:
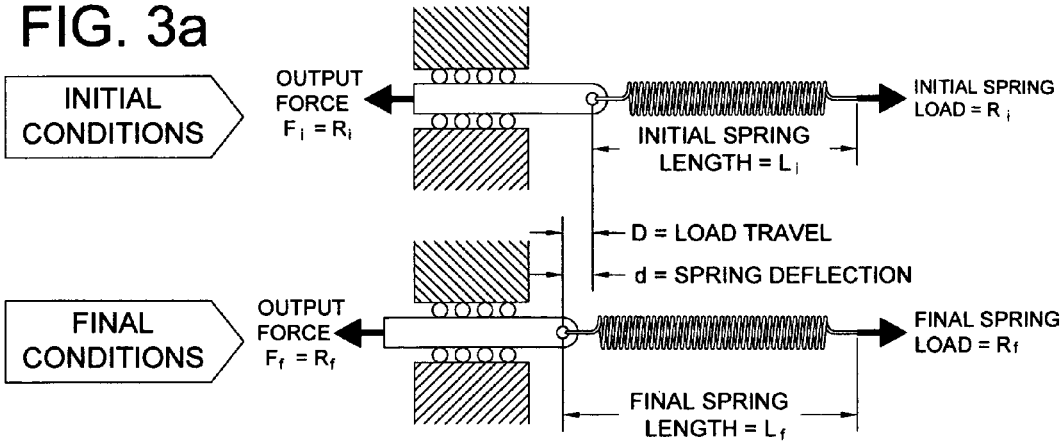
Figure 3B:
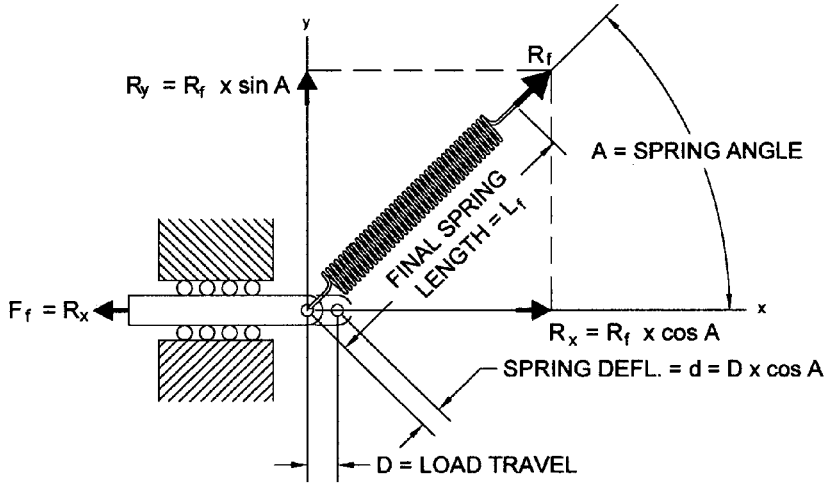
Figure 3C:
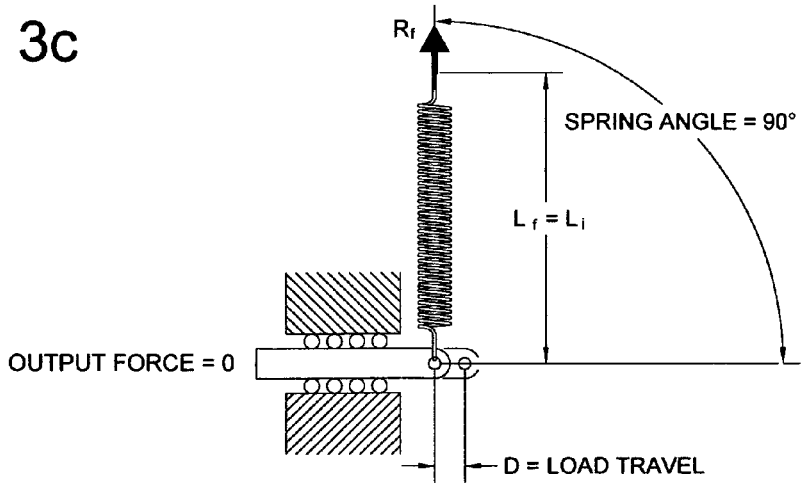

FIG. 3*a* through 3*c* show the relationships between the input and output variables as the counterbalance spring is rotated between 0 and 90 degrees.

FIG. 3*d* through 3*g* show how the spring initial tension can be varied as the adjustable spring arm rotates.

Figure 4A:
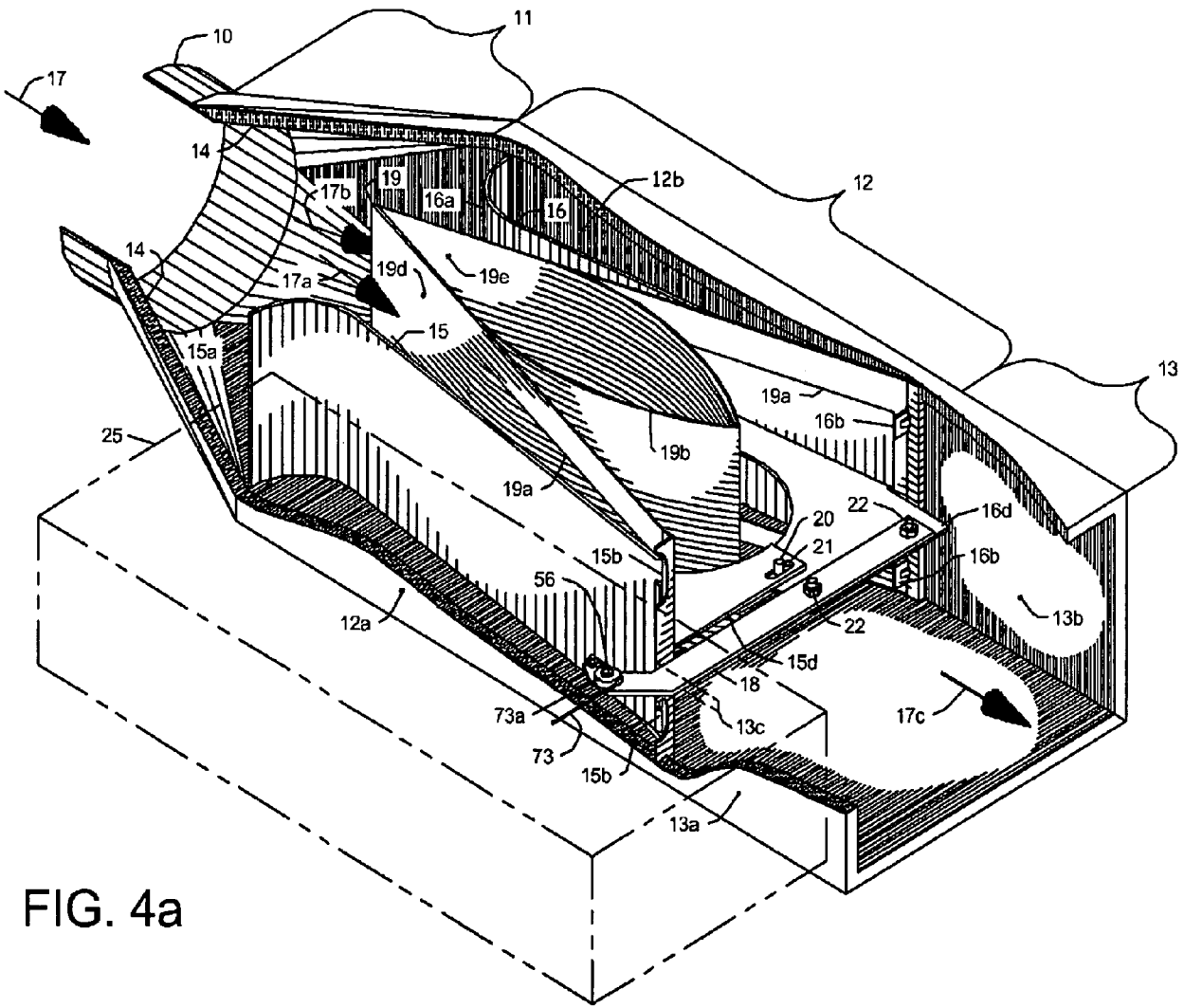

FIG. 4*a* is an isometric view of the preferred embodiment showing the airflow section of the air volume regulator with part of the exterior shell broken away and the casing of spring counterbalance system outlined in the foreground.

Figure 4B:
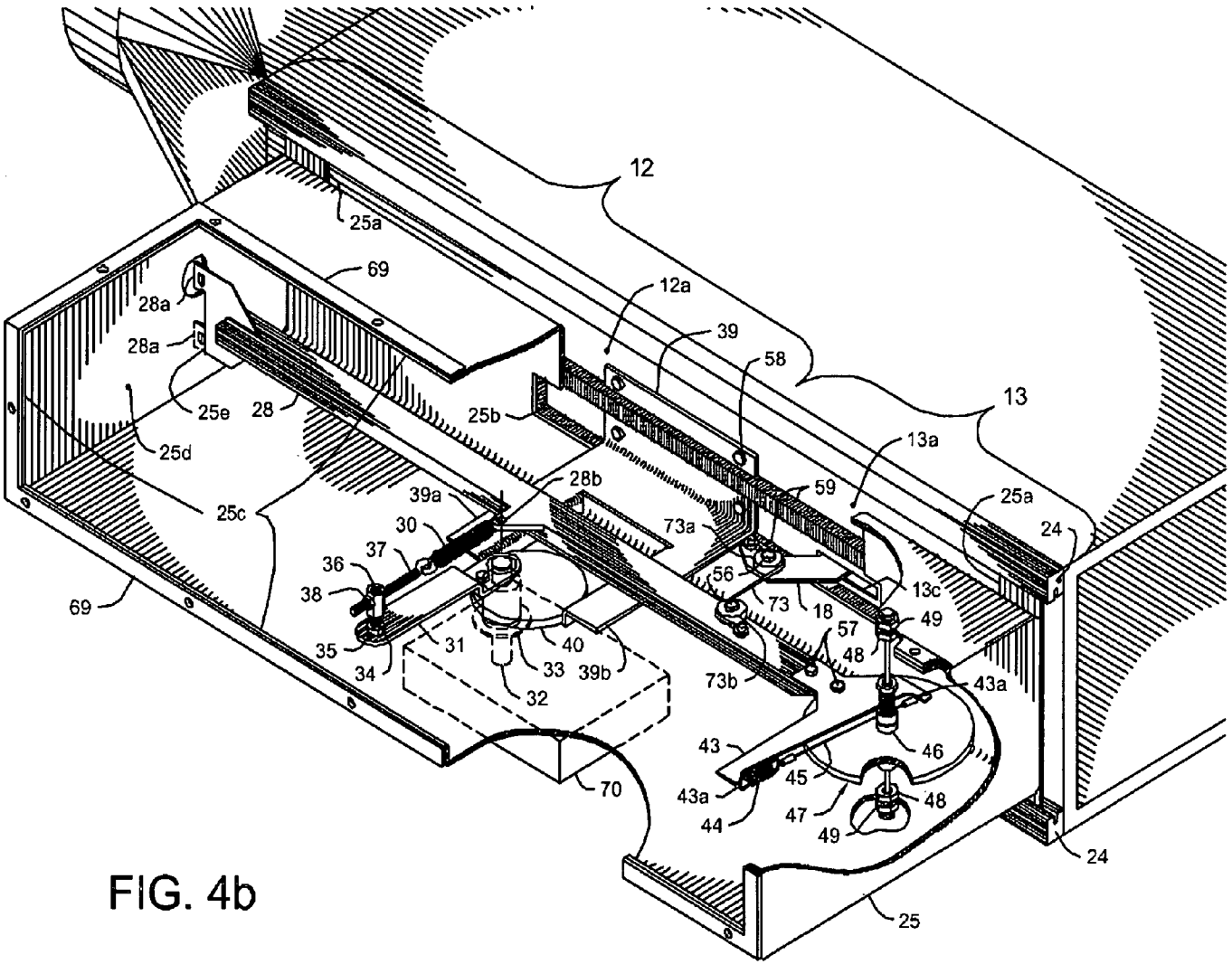

FIG. 4*b* is an isometric view of the preferred embodiment showing the spring counterbalance system with its protective shroud removed and the airflow section beyond.

Figure 4C:
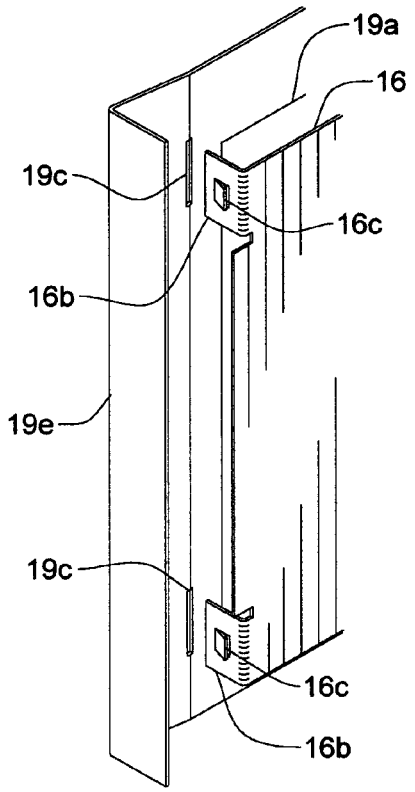

FIG. 4*c* is a partial exploded isometric view of the preferred embodiment showing the proposed pivot hinge.

Figure 4D:
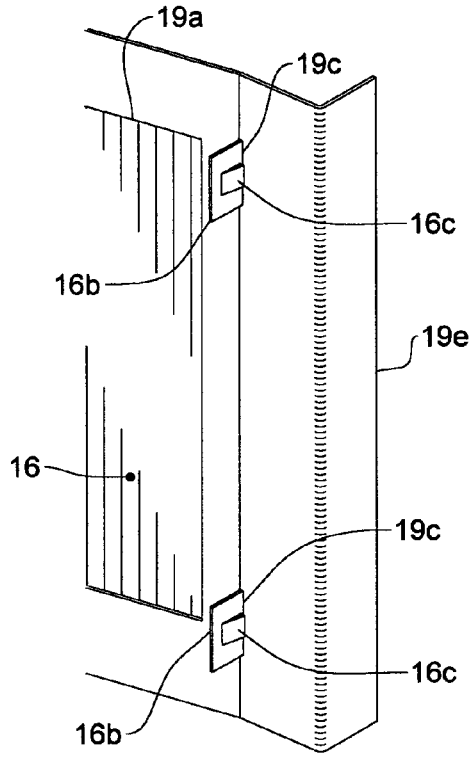

FIG. 4*d* is a partial isometric view of the preferred embodiment showing the proposed pivot hinge assembly.

Figure 4E:
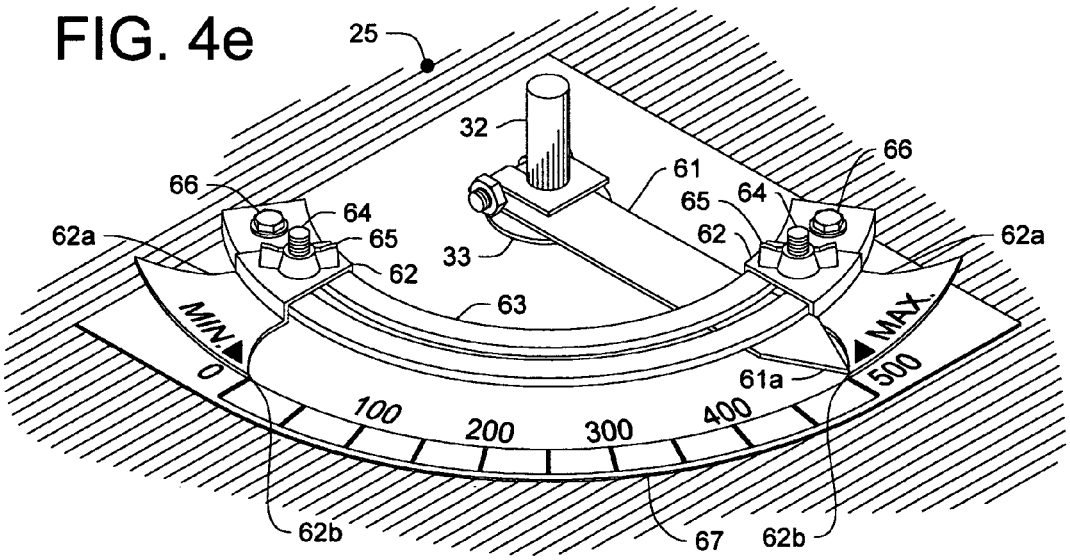

FIG. 4*e* is an isometric view of the airflow setting quadrant of the preferred embodiment.

Figure 4F:
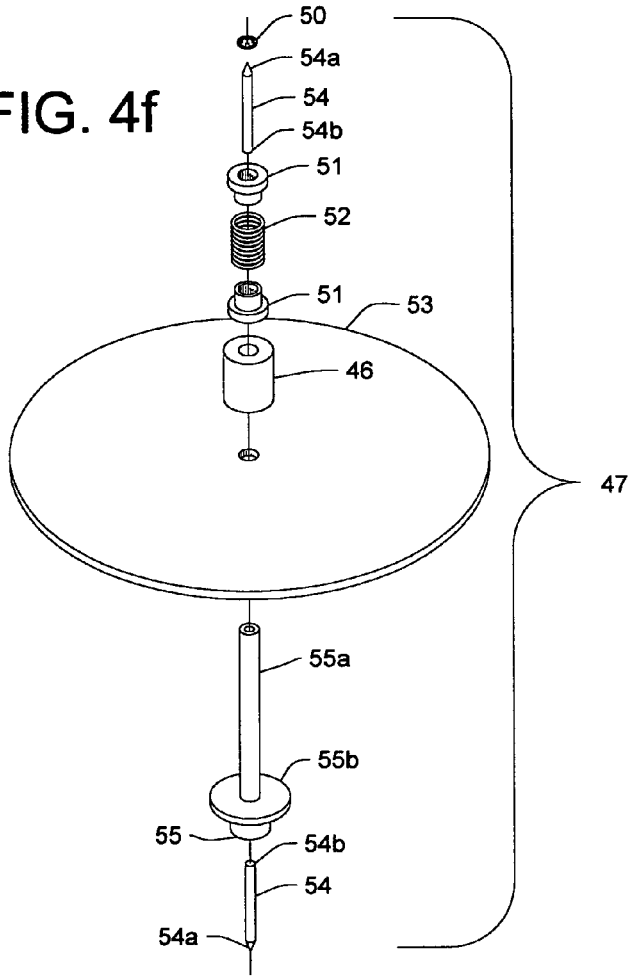

FIG. 4*f* shows an exploded view of the dampener flywheel assembly of the preferred embodiment.

Figure 4G:
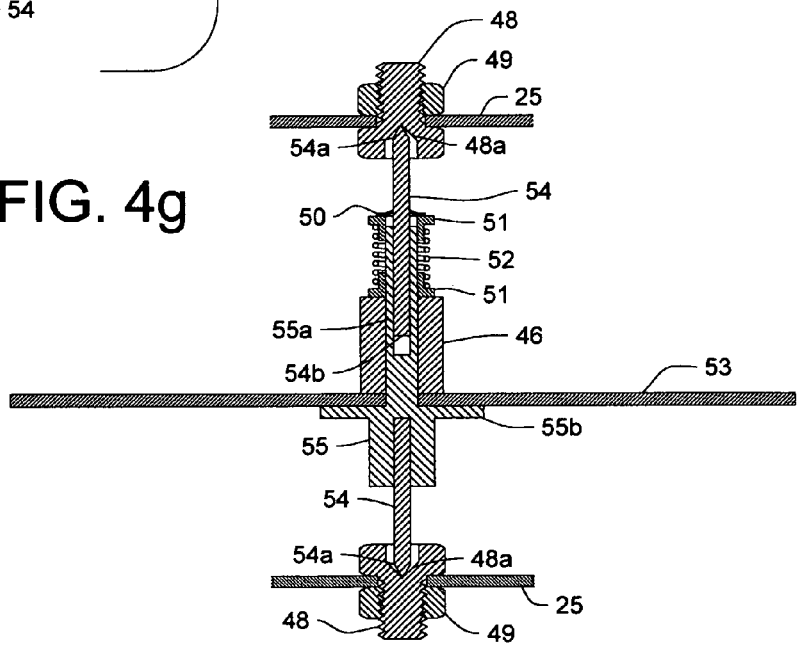

FIG. 4*g* shows a typical cross-section through the dampener flywheel and the pivot bearings.

Figure 4H:
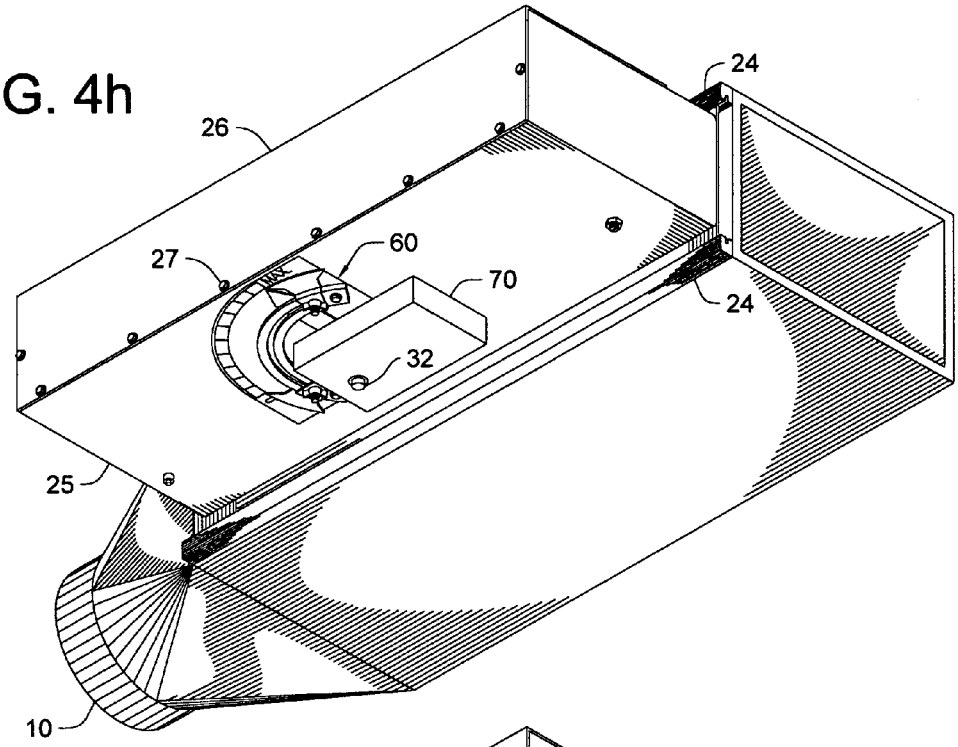
Figure 4I:
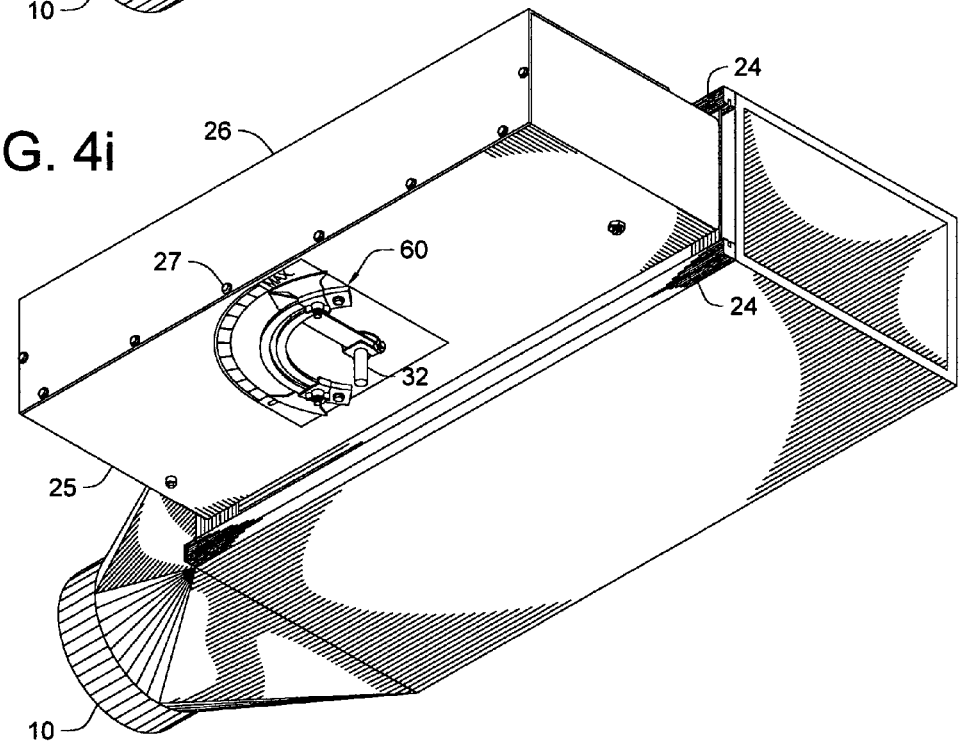

FIGS. 4*h* and 4*i* show the air volume regulator viewed from below with and without an option actuator.

Figure 5A:
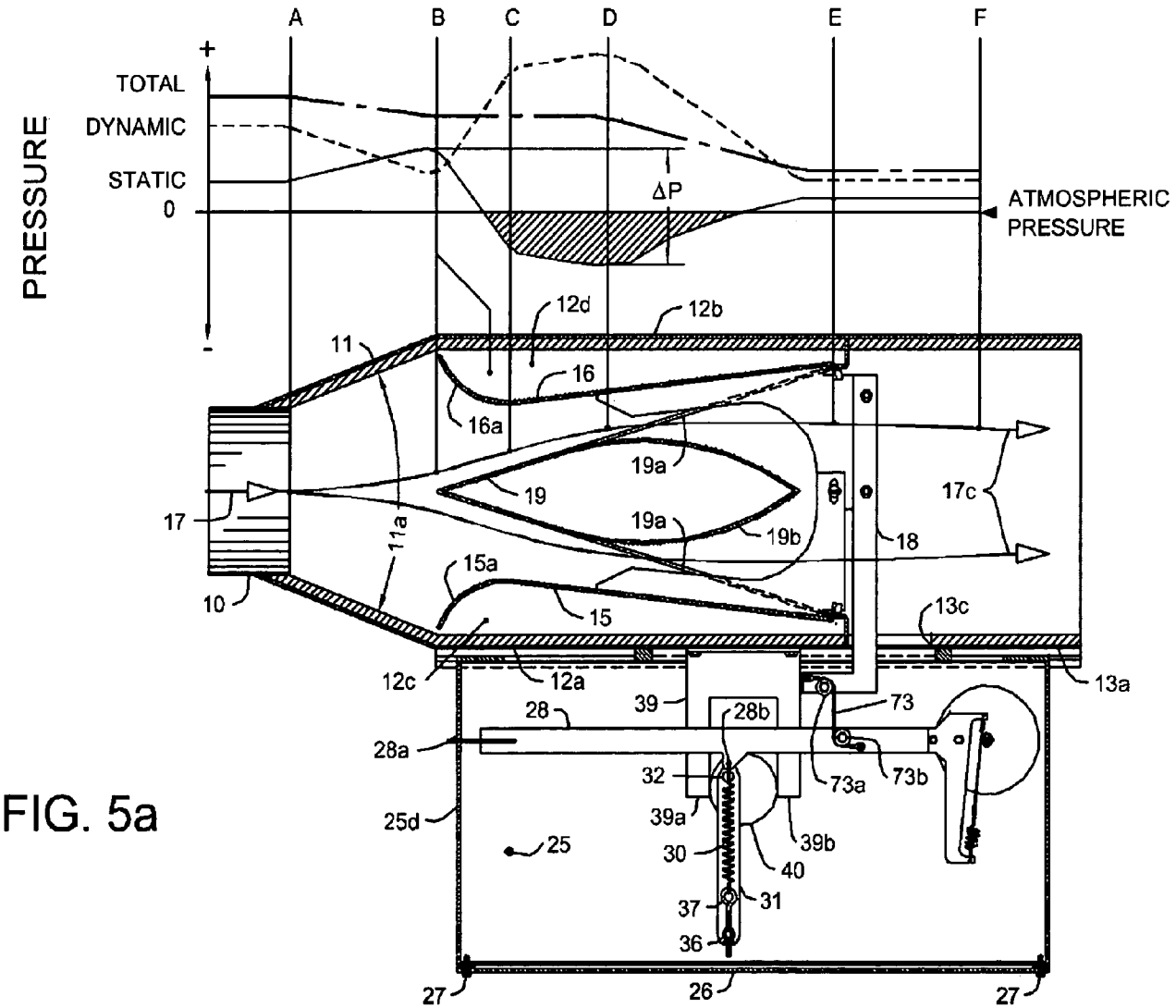

FIGS. 5*a*, 5*b*, 5*c*, 5*d* and 5*e* are sectional views of the preferred embodiment showing the positions assumed by the components under various conditions of upstream pressure and airflow settings where:

FIG. 5*a* shows a cut-away plan view of the air volume regulator at maximum flow rate and at minimum pressure.

Figure 5B:
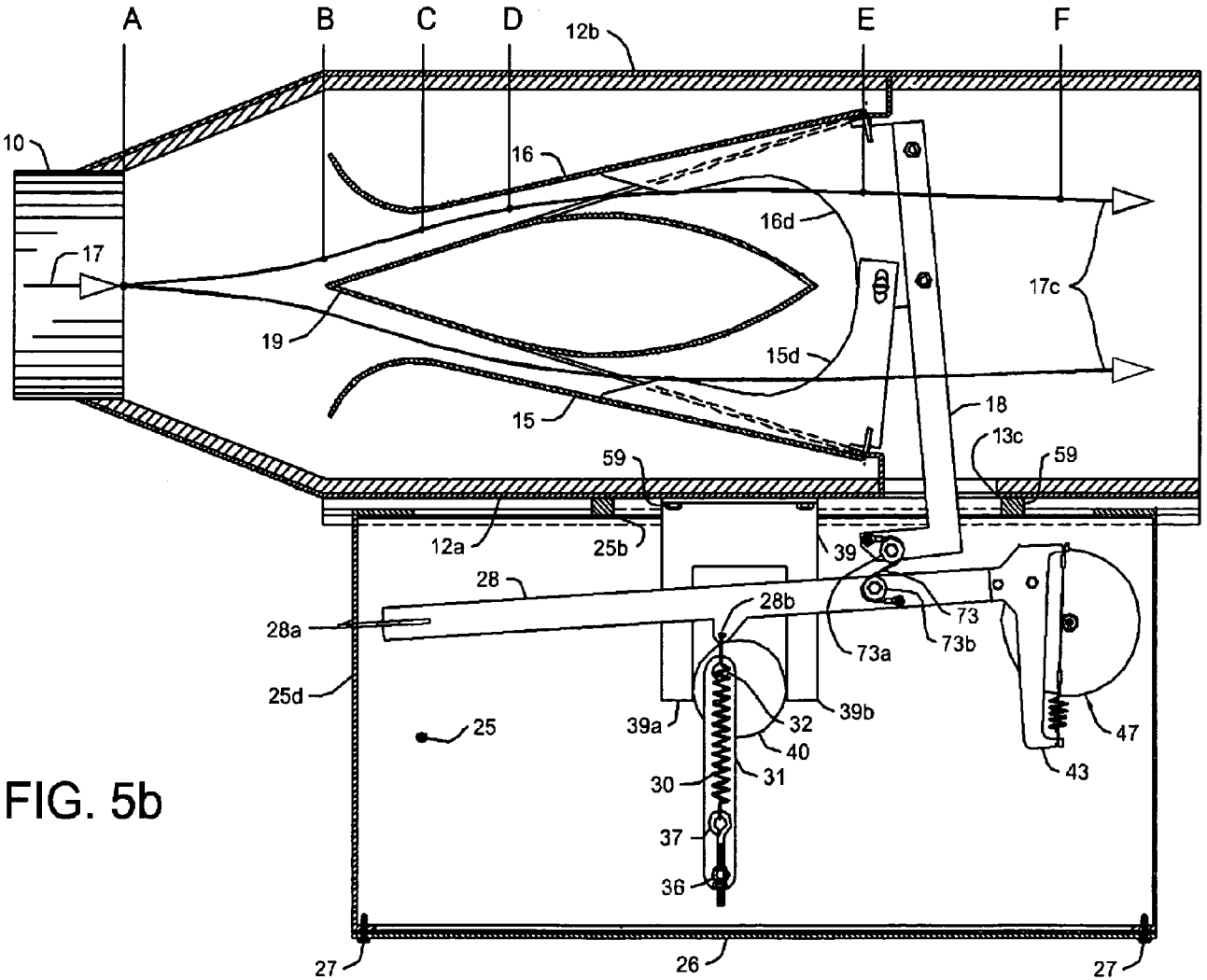

FIG. 5*b* shows a cut-away plan view of the air volume regulator at maximum flow rate and at maximum pressure.

Figure 5C:
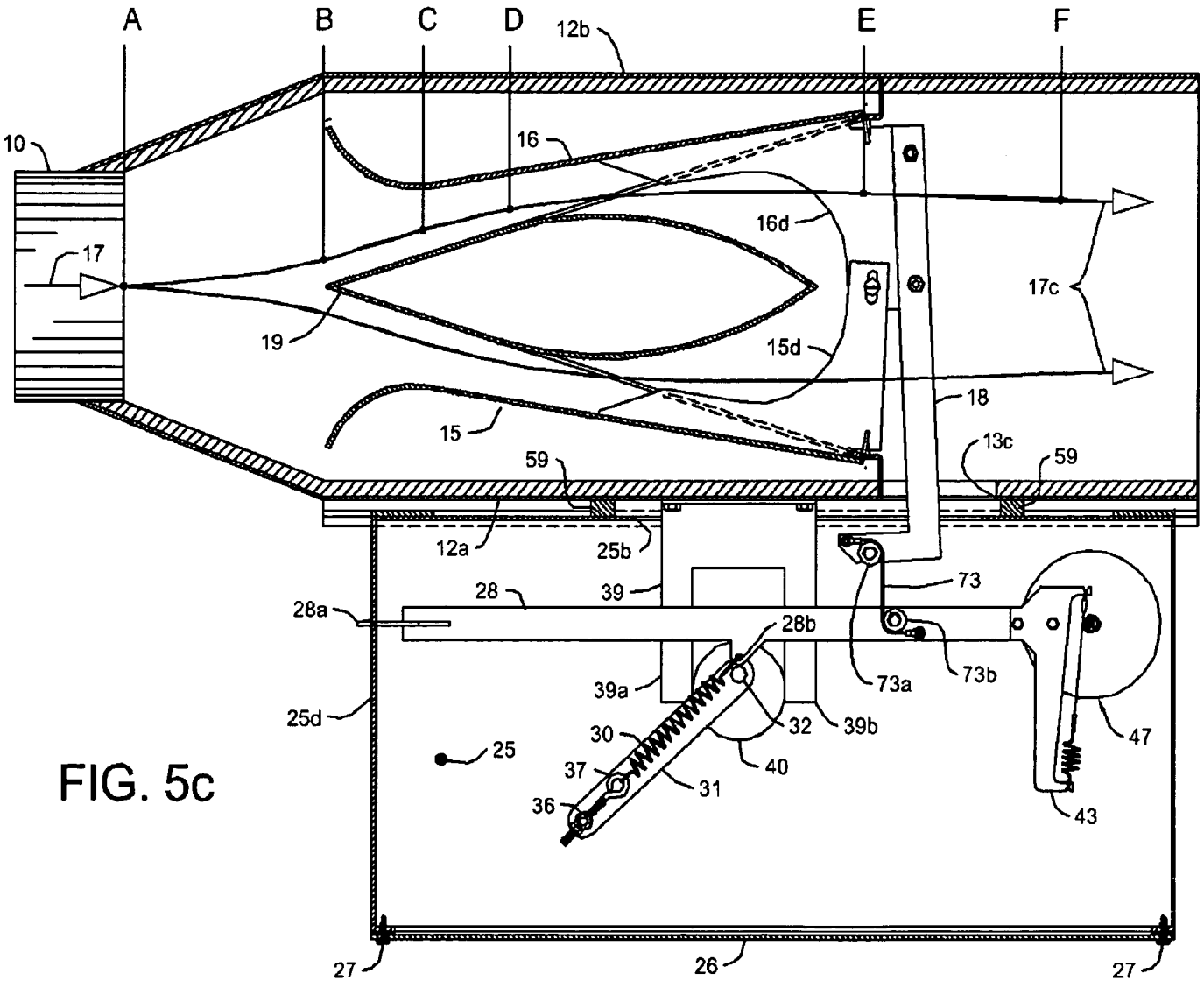

FIG. 5*c* shows a cut-away plan view of the air volume regulator at a reduced flow rate and at minimum pressure.

Figure 5D:
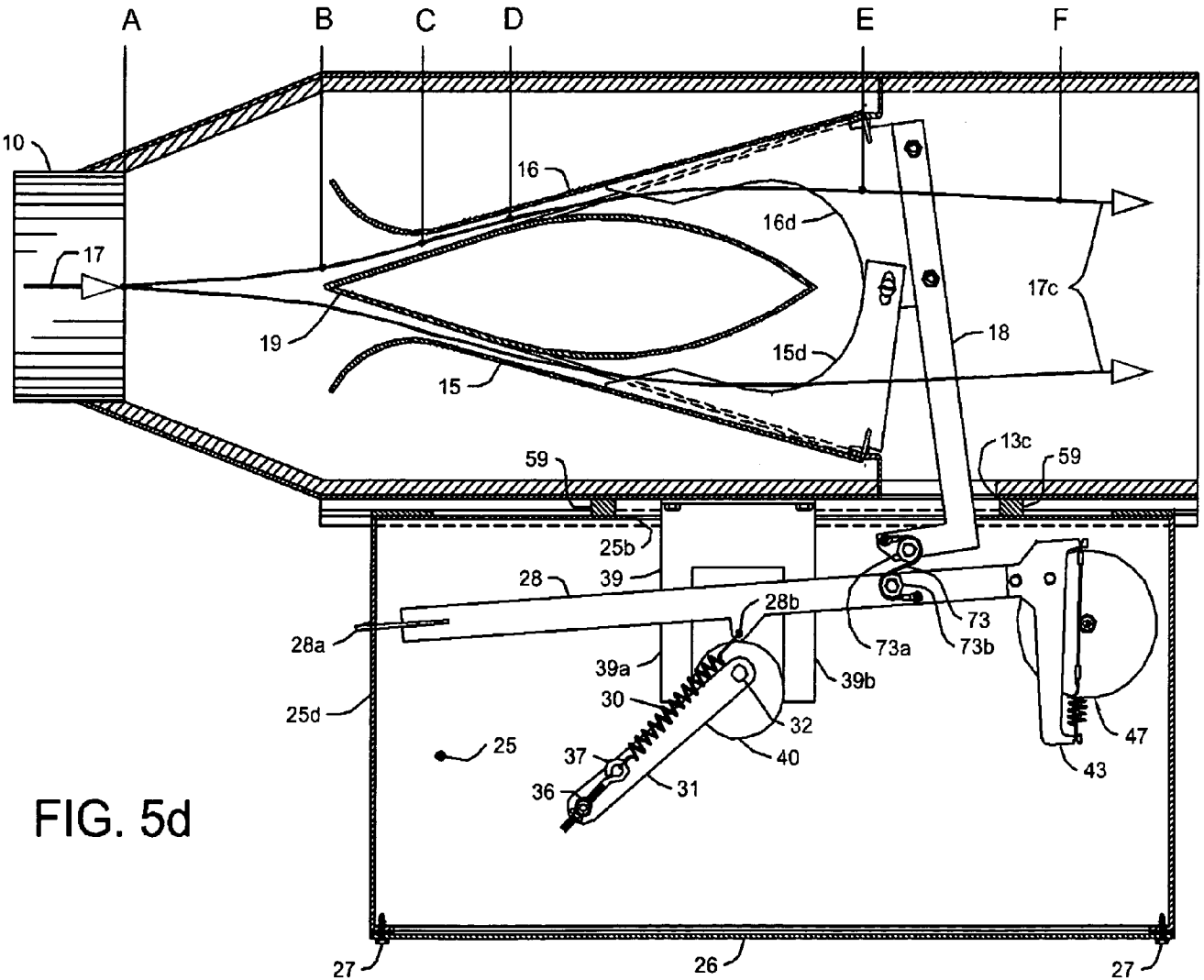

FIG. 5*d* shows a cut-away plan view of the air volume regulator at a reduced flow rate and at maximum pressure.

Figure 5E:
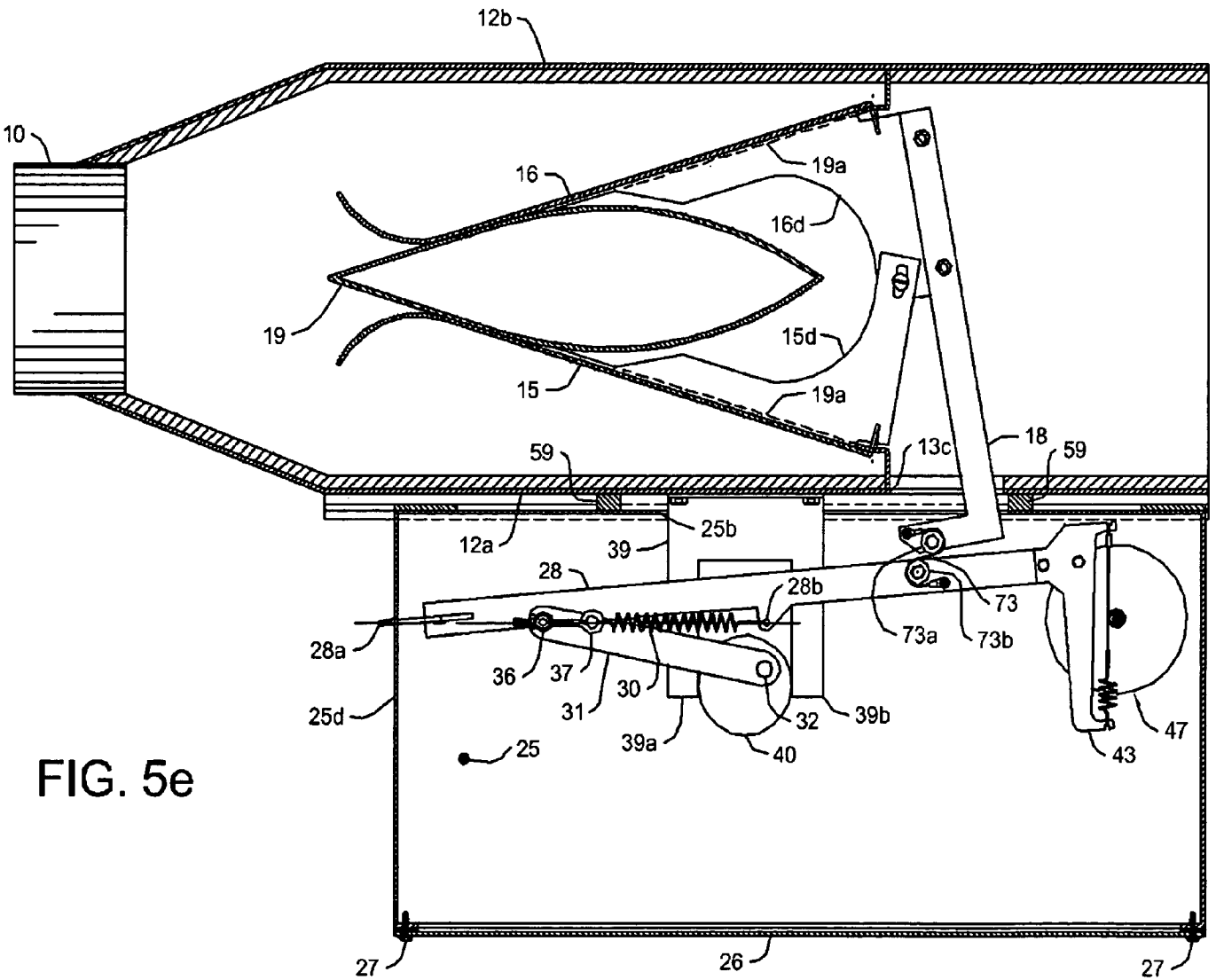

FIG. 5*e* shows a cut-away plan view of the air volume regulator at zero flow rate.

Figure 6A:
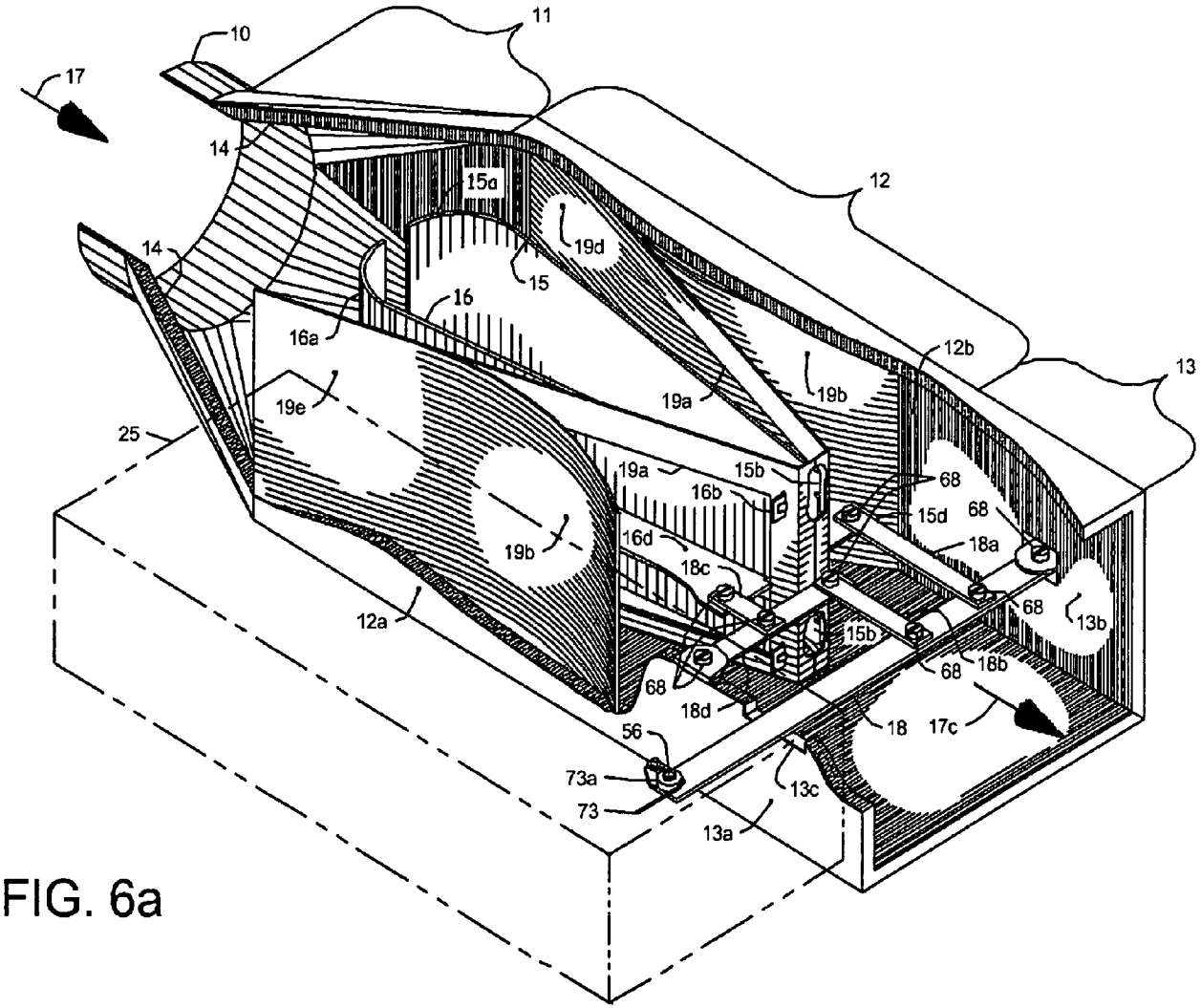

FIG. 6*a* is an isometric view of an alternative embodiment of the airflow section of the air volume regulator with part of the exterior shell broken away and the protective shroud of the spring counterbalance system outlined in the foreground.

Figure 6B:
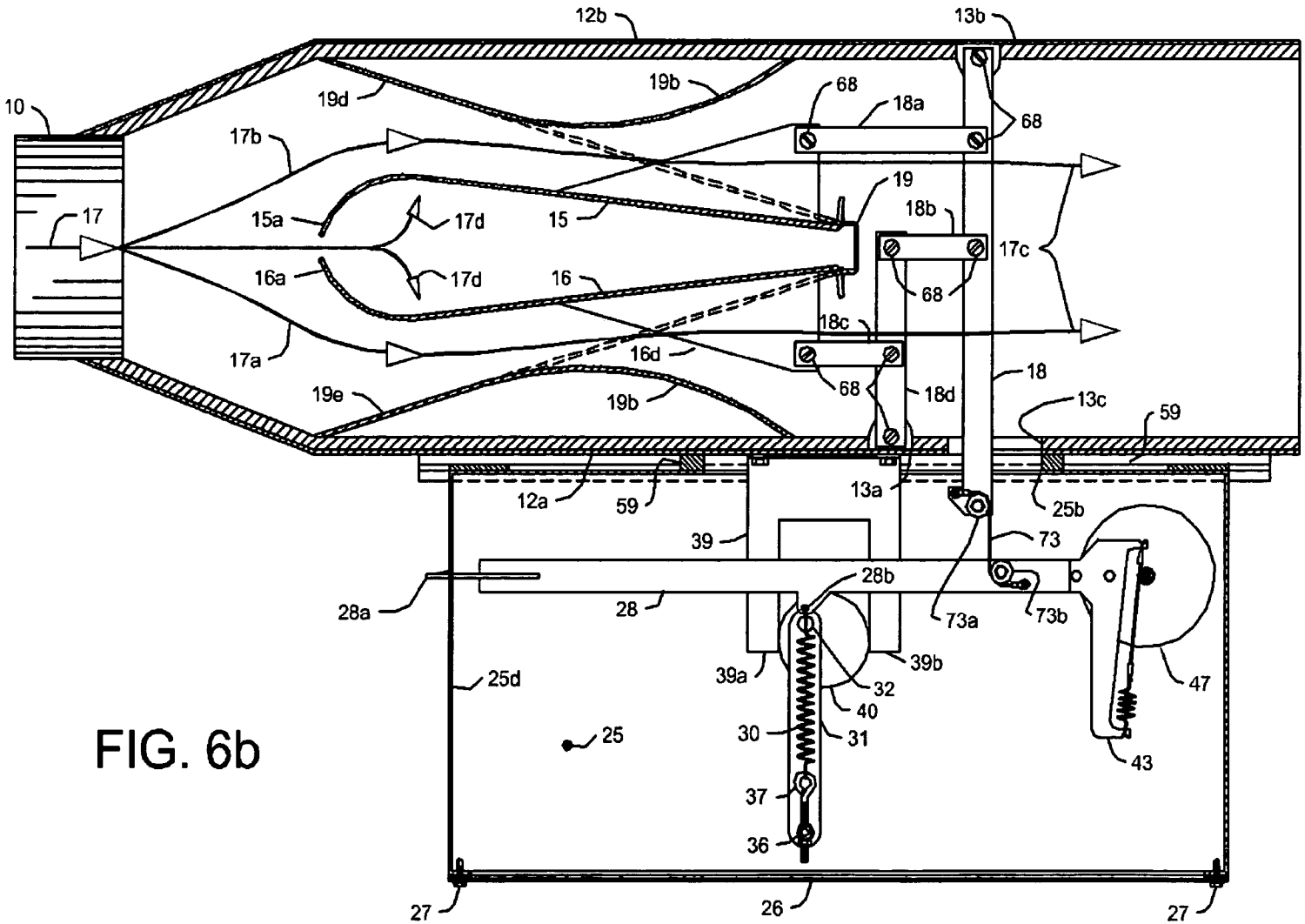

FIG. 6*b* shows a cut-away plan view of the alternative embodiment of FIG. 6*a* at maximum flow rate and at minimum pressure.

Figure 7A:
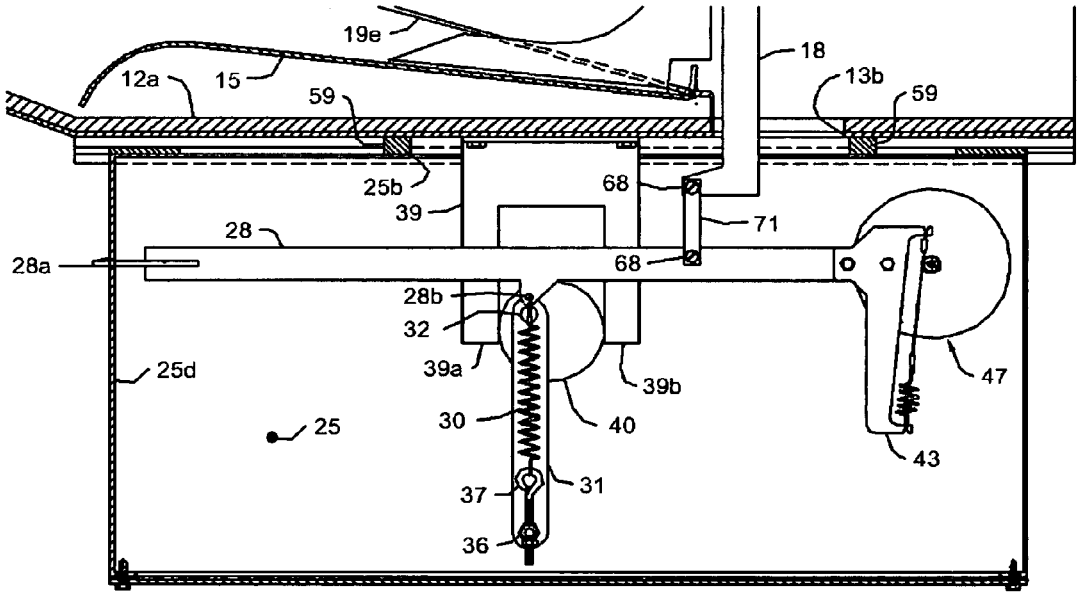
Figure 7B:
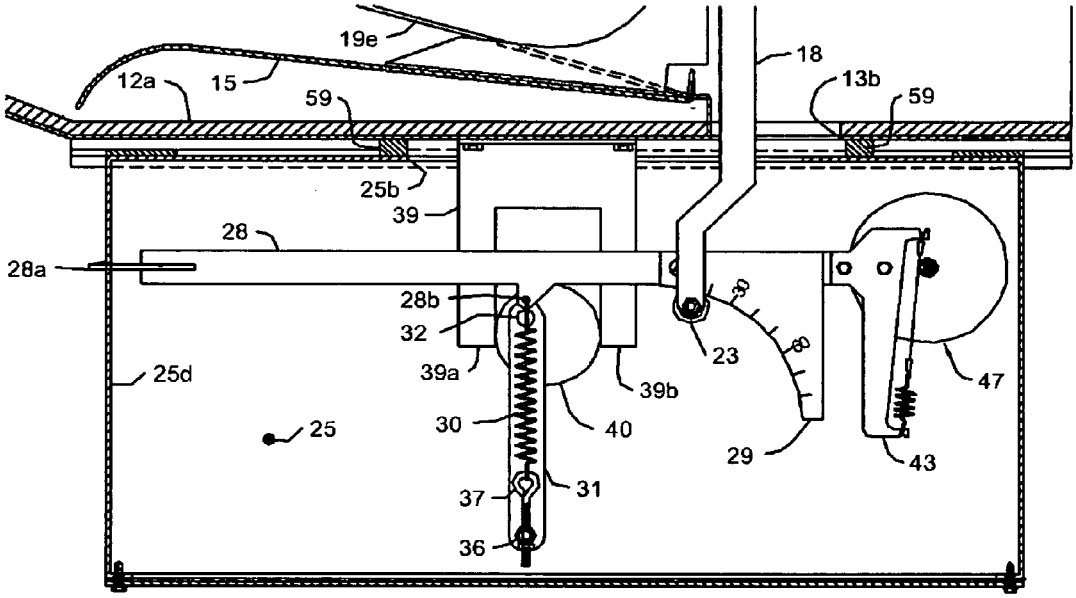

FIGS. 7*a* and 7*b* show cut-away plan views of alternatives to the coupling cable and cable cams with the air volume regulator at maximum flow rate and no air entering the unit.

Figure 8A:
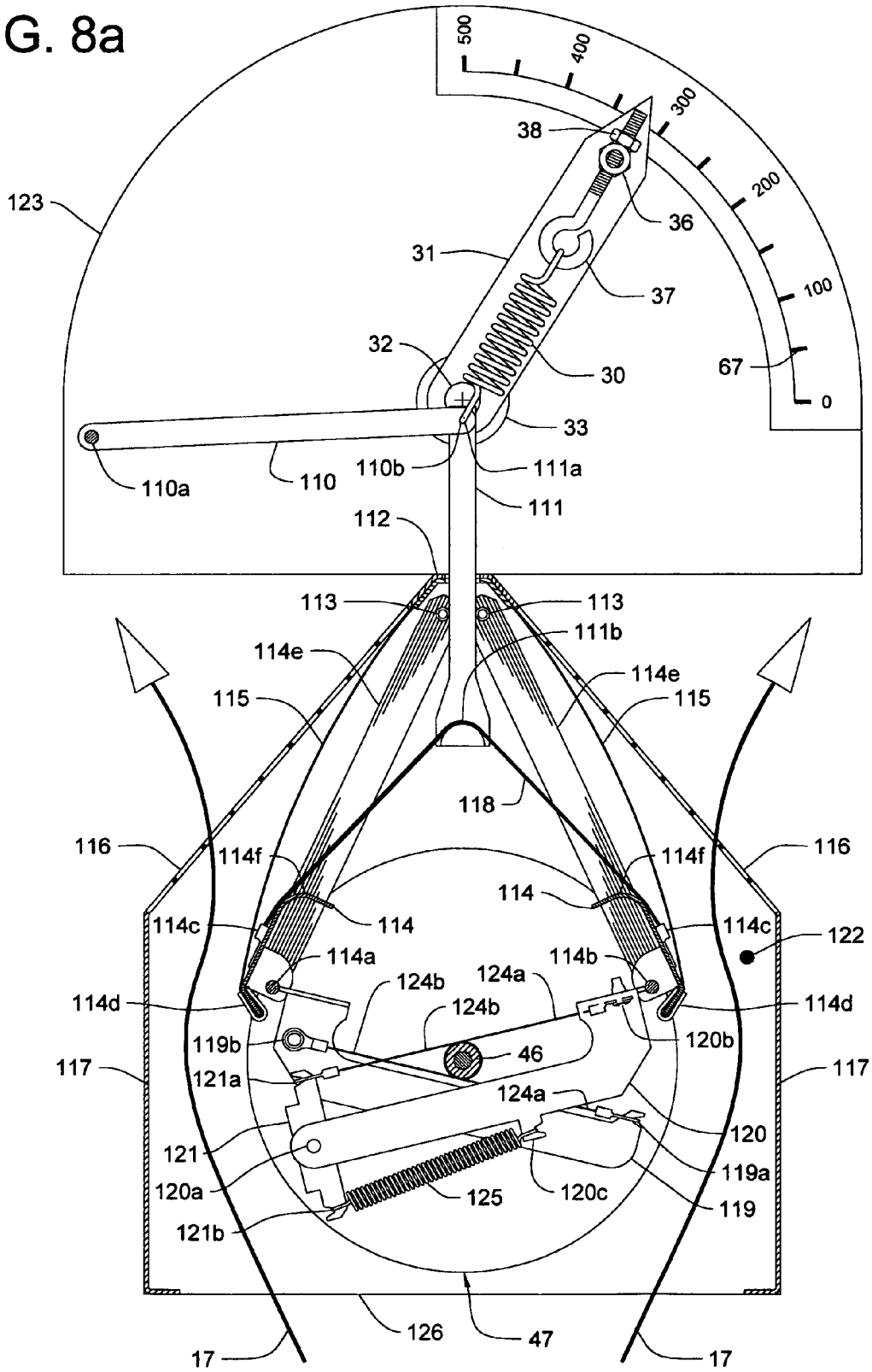

FIG. 8*a* shows the upgrading of an existing air volume regulator design with an adjustable counterbalance spring assembly and a cable driven flywheel.

Figure 8B:
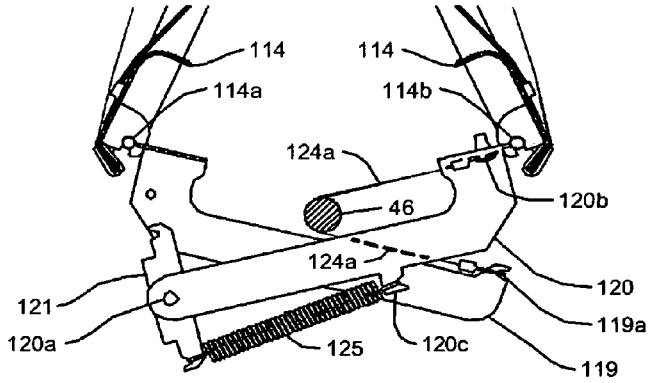
Figure 8C:
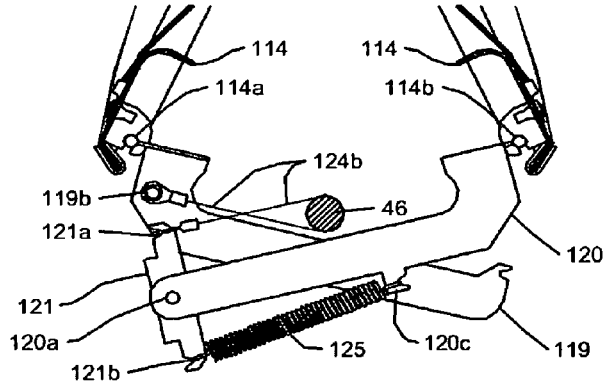

FIGS. 8*b* and 8*c* show the details of the configuration of the drive cables of FIG. 8*a*.

Figure 9:
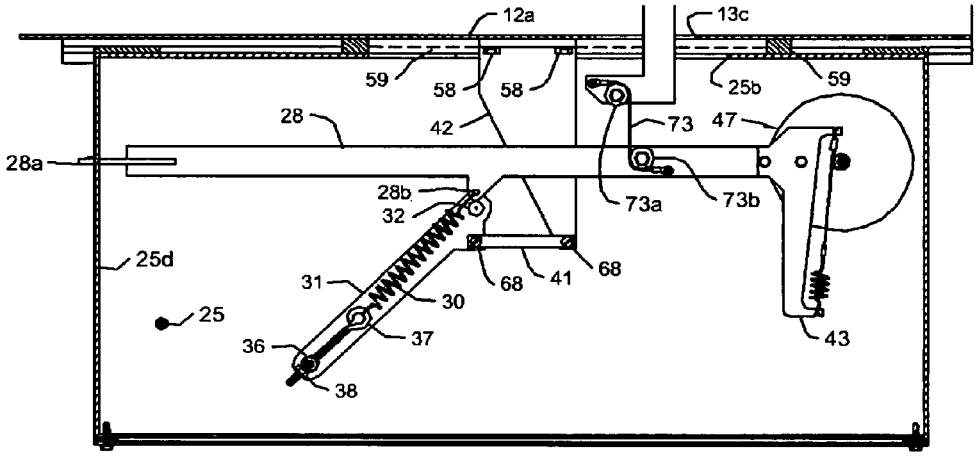

FIG. 9 show a cut-away plan view of an alternative to the eccentric cam and guide angle.

DRAWINGS—LIST OF REFERENCE NUMERALS

In the drawings, related elements of a given part have the same number but different alphabetic suffixes.

| | | | |
|---|---|---|---|
| 10 | inlet section | 11 | optional transition section |
| 11a | included angle of transition section | 12 | flow constricting section |
| 12a | sidewall adjacent to idler gate | 12b | sidewall adjacent to drive gate |
| 12c | plenum adjacent to idler gate | 12d | plenum adjacent to drive gate |
| 13 | outlet section | 13a | sidewall of outlet section |
| 13b | sidewall of outlet section | 13c | opening in sidewall of outlet section |
| 14 | thermal & acoustic material | 15 | idler gate |
| 15a | idler gate upstream end | 15b | idler gate pivot tab |
| 15c | idler gate locking tab (not shown) | 15d | idler gate bracket |
| 16 | drive gate | 16a | drive gate upstream end |
| 16b | drive gate pivot tab | 16c | drive gate locking tab |
| 16d | drive gate bracket | 17 | entering air stream |
| 17a | air stream passing idler gate | 17b | air stream passing drive gate |
| 17c | air stream at outlet | 17d | air stream between the gates |
| 18 | gate lever | 18a | gate lever link A |
| 18b | gate lever link B | 18c | gate lever link C |
| 18d | gate lever link D | 19 | "V" baffle |
| 19a | "V" baffle openings | 19b | "V" baffle curved air guide |
| 19c | "V" baffle pivot tab slot | 19d | "V" baffle arm |
| 19e | "V" baffle arm | 20 | coupling pin |
| 21 | coupling pin slot | 22 | gate lever fasteners |
| 23 | follower bearing | 24 | track |
| 25 | chassis | 25a | chassis guide plate |
| 25b | chassis opening | 25c | chassis access opening |
| 25d | chassis end panel | 25e | shuttle pivot slots |
| 26 | removable shroud | 27 | shroud fasteners |
| 28 | shuttle | 28a | shuttle pivot tabs |
| 28b | counterbalance spring pivot hole | 29 | cam |
| 30 | counterbalance spring | 31 | spring arm |
| 32 | actuator shaft | 33 | low friction sleeve bearing |
| 34 | threaded pivot bolt | 35 | threaded pivot bolt locking nut |
| 36 | extension nut | 37 | threaded eye bolt |
| 38 | adjusting nut | 39 | guide angle |
| 39a | upstream guide angle arm | 39b | downstream guide angle arm |
| 40 | eccentric circular cam | 41 | connecting link |
| 42 | retaining angle | 43 | flywheel drive bow |
| 43a | flywheel drive bow cable hook | 44 | drive cable tensioning spring |
| 45 | flywheel drive cable | 46 | flywheel drive bushing |
| 47 | dampener flywheel assembly | 48 | conical cup bearing |
| 48a | conical cup bearing recess | 49 | conical cup bearing nut |
| 50 | internal tooth retaining ring | 51 | spring alignment shoulder washer |
| 52 | compression spring | 53 | flywheel disk |
| 54 | flywheel pivot pins | 54a | flywheel pivot pins pointed end |
| 54b | flywheel pivot pins blunt end | 55 | flywheel shaft |
| 55a | guide portion of flywheel shaft | 55b | flywheel support flange |
| 56 | cam fastener | 57 | flywheel bow fastener |
| 58 | guide angle fastener | 59 | chassis sliding seal |
| 60 | airflow setting quadrant assembly | 61 | flow indicator arm |
| 61a | pointed end of flow indicator arm | 62 | "U" shaped adjustable limit stops |
| 62a | limit stops leg | 62b | limit stops leg cusp |
| 63 | slotted quadrant | 64 | carriage bolt |
| 65 | wing nut | 66 | quadrant fastener |
| 67 | air volume scaled decal | 68 | pivot screw |
| 69 | shroud seal | 70 | optional actuator |
| 71 | coupling link | 72 | (not used) |
| 73 | coupling cable | 73a | cable cam |
| 73b | cable cam | | |
| 74 to 109 | (not used) | | |
| 110 | retaining arm | 110a | retaining arm pivot pin |
| 110b | spring pivot hole | 111 | tension link |
| 111a | tension link pivot hole | 111b | tension link hook |
| 112 | airframe crown | 113 | curtain frame pivot pin |
| 114 | curtain frame | 114a | pivot point of drive bow 119 |
| 114b | pivot point of drive bow 120 | 114c | anchoring point of equalizer cable |
| 114d | anchoring edge of flexible curtain | 114e | curtain frame pivot arm |
| 115 | impervious flexible curtain | 116 | pervious pitched sidewall |
| 117 | impervious sidewall | 118 | equalizer cable |
| 119 | drive bow | 119a | anchorage point of drive cable |

-continued

| | | | |
|---|---|---|---|
| 119b | anchorage point of drive cable | 120 | drive bow with tightener |
| 120a | tensioning link pivot point | 120b | anchorage point of drive cable |
| 120c | tensioning spring hook | 121 | tensioning link |
| 121a | anchorage of drive cable | 121b | anchorage of tensioning spring |
| 122 | impervious end wall | 123 | mounting plate |
| 124a | flywheel drive cable | 124b | flywheel drive cable |
| 125 | tensioning spring | 126 | inlet opening |

DETAILLED DESCRIPTION—PREFERRED EMBODIMENT—FIGS. 4*a* to 4*i*

The preferred embodiment of the air volume regulator of the present invention is illustrated in FIG. 4*a*—Isometric view of the flow control module and FIG. 4*b*—Isometric view of the spring counterbalance system. Referring to FIG. 4*a,* the air volume regulator is comprised of a housing of generally rectangular section having:

(a) an upstream end or inlet 10, generally cylindrical in shape, through which conditioned air under pressure is supplied to the air volume regulator, (b) a flow constriction section 12 with sides walls 12*a* and 12*b,*

(c) an optional expansion or transition section 11 required if the area of inlet 10 is smaller than that of flow constriction section 12. The length of transition section 11 is sufficient to permit the efficient conversion of at least 75% of the reduction in dynamic pressure between inlet 10 and transition section 11 to static pressure as per the known practice of "static regain".

(d) an outlet or downstream section 13 through which the conditioned air is conveyed to the room or space to be conditioned.

As is conventional, the inner surfaces of the walls of transition section 11, flow constriction section 12, and outlet section 13 may be covered with a suitable thermal acoustic insulating material 14. Flow constriction section 12 includes two opposing pivoted sidewalls or gates 15 and 16 and a "V" shaped baffle 19. Gate 15 is defined as an idler gate and gate 16 as a drive gate. Baffle 19 is positioned centrally in section 12 with its apex pointing upstream to divide entering airstream 17 into two airstreams 17*a* and 17*b*. Upstream ends 15*a* and 16*a* of gates 15 and 16 respectively are curved away from baffle 19 so as to direct airstreams 17*a* and 17*b* against baffle arms 19*d* and 19*e*. Idler gate 15 is attached to baffle arm 19*d* by two pivot tabs 15*b* at its downstream end such that it can freely swing between baffle arm 19*d* and sidewall 12*a*. Similarly, drive gate 16 is attached to baffle arm 19*e* by two pivot tabs 16*b* at its downstream end such that it can freely swing between baffle arm 19*e* and sidewall 12*b*. FIG. 4*c* shows a partial exploded isometric view of baffle arm 19*e* at its downstream end and drive gate 16 not installed; FIG. 4*d* shows a partial isometric view of baffle arm 19*e* at its downstream end and viewed from the airstream side with drive gate 16 installed. Pivot tabs 16*b* are identical to pivot tabs 15*b* on gate 15. Pivot tabs 16*b* are inserted in two pivot tab slots 19*c* in baffle arm 19*e* and two locking tabs 16*c* are compressed as they pass through pivot tab slots 19*c*. When pivot tabs 16*b* are fully inserted, locking tabs 16*c* snap back to their original shape and lock gate 16 in slots 19*c*. Pivot tabs 16*b* now act as a hinge. Pivot tab slots 19*c* are sufficiently wide and high so that gate 16 swing freely on pivot tabs 16*b* without being overly loose.

Now returning back to FIG. 4*a,* the height of gates 15 and 16 is substantially the same as inlet 10 and their total length is approximately 3 times their height. Baffle 19 expands downstream from its apex to sides 12*a* and 12*b* respectively of flow constriction section 12. It is fixedly sealed to flow constriction section 12 on all its outer edges. Two openings 19*a* are cut in baffle arms 19*d* and 19*e* to permit the free passage of the air towards outlet section 13. The height of openings 19*a* is smaller than the gate height such that gates 15 and 16 can completely cover them. The length of openings 19*a* is at approximately 2/3 the length of baffle arms 19*d* and 19*e*. A curved baffle air guide 19*b* extends from the upstream edges of openings 19*a,* downstream between baffle arms 19*d* and 19*e*. Optionally, baffle air guide 19*b* may be ogival, elliptical or round extending downstream.

An idler gate bracket 15*d* and a drive gate bracket 16*d* are fixedly attached to gates 15 and 16 respectively extending into the airstream and through openings 19*a*. Gate brackets 15*d* and 16*d* movably link gates 15 and 16 together through a coupling pin 20 sliding in an alignment slot 21. Coupling pin 20 forces gates 15 and 16 to operate in unison but in opposite directions with substantially equal angular rotations. A gate lever 18 is fixedly attached to the downstream edge of drive gate bracket 16*d* with two fasteners 22 and extends from it around the downstream end of baffle 19 and through an opening 13*c* in sidewall 13*a*. A coupling cable 73 is attached to the other end of gate lever 18 by one end and partially wrapped around a cable cam 73*a*. Coupling cable 73 then extends perpendicular to sidewall 13*a* and away from it. Coupling cable 73 can be made from stranded steel or stainless steel miniature cable, or a synthetic polyester fiber string such as DACRON® by DuPont. The relative position of coupling cable 73 is such that the axis of it's extended portion and the pivot axes of gates 15 and 16 are substantially in the same plane when no pressurized air is supplied to the air volume regulator. As a result, when air begins to flow through the regulator, the direction of movement of cable cam 73*a* is substantially linear and parallel to sidewall 13*a* and in the downstream direction.

Now referring to FIG. 4*b,* the counterbalance section includes two tracks 24 that are fixedly attached along the length of sidewalls 12*a* and 13*a*. Guided within tracks 24, two chassis guide plate 25*a* slide parallel to sidewalls 12*a* and 13*a* and are fixedly attached to a chassis 25. An opening 25*b* is cut in chassis 25 to allow the free passage of gate lever 18. An airtight sliding seal 59 is inserted around the perimeter of opening 25*b* in the space between chassis 25 and sidewalls 12*a* and 13*a*. It is fixedly attached to chassis 25 and in sliding contact with sidewalls 12*a* and 13*a*. Chassis 25 has an upstream end panel 25*d* into which two pivot slots 25*e* are cut. A shuttle 28 with two pivot tabs 28*a* is inserted into pivot slots 25*e*. Pivot tabs 28*a* are substantially of the same construction as pivot tabs 15*b* and 16*b*. Their pivot axis is substantially parallel to the axes of gates 15 and 16. A second cable cam 73*b* and the second end of coupling cable 73 are fixedly attached to shuttle 28 with fasteners 56 such that coupling cable 73 is partially wrapped around cable cam 73*b*. The initial center distance between cable cams 73*a* and 73*b,* and their common diameters is determined experimentally and is proportional to the maximum travel of coupling cam 73*a*. As can be seen, the linking of the gate lever 18 with shuttle 28 by coupling cable 73 is such that when gate lever 18 moves cable cam 73*a* and the first end of coupling cable 73 in a downstream direction, coupling cable 73 pulls on shuttle 28, rotating it about pivot tabs 28*a* towards sidewall 13*a* and at right angle to the travel of cable cam 73*a*. A counterbalance spring 30 is inserted in a counterbalance spring pivot hole 28*b* on shuttle 28 such that it can freely rotate from a position perpendicular to shuttle 28 to a position substantially parallel to it.

A low friction sleeve bearing 33 is fixedly mounted through chassis 25 such that its axis of rotation is parallel to the axis of shuttle 28. Although some experimental fine-tuning is required to determine the precise location of the axis of sleeve bearing 33 on chassis 25, its axis of rotation is in close proximity to the axis of hole 28*b*. An actuator shaft 32 with a spring arm 31 fixedly mounted to its distal end is inserted into sleeve bearing 33 to freely rotate. A threaded pivot bolt 34 is fixedly attached using a locking nut 35 to the distal end of spring arm 31. An extension nut 36 is screwed onto the end of pivot bolt 34 such that it can freely rotate approximately 45 degrees once in place. A hole is drilled in the distal end of extension nut 36 perpendicular to its axis into which a threaded eye bolt 37 is inserted with a sliding fit. An adjusting nut 38 is added to retain eye bolt 37 within the hole in extension nut 36. With one end of counterbalance spring 30 mounted in hole 28*b* as outlined above, its opposite end is inserted in the eye of eye bolt 37.

An optional actuator 70 of know construction is shown mounted to actuator shaft 32 on the exterior of casing 25.

Figure 3D:
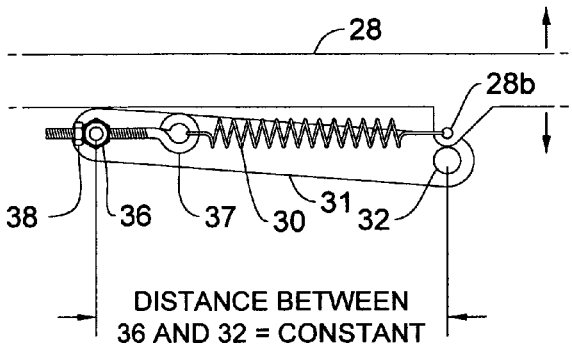
Figure 3E:
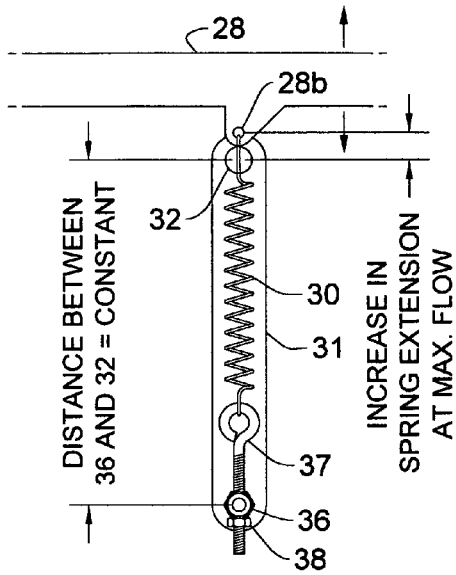

Experimentation has shown that counterbalance spring 30 requires more initial tension at maximum airflow. This progressive increase can be accomplishes by relocating actuator shaft 32 away from hole 28*b* in a perpendicular direction from shuttle 28. Referring to FIG. 3*d*, the extended length of counterbalance spring 30 varies as the distance between extension nut 36 and hole 28*b*. At minimum airflow with spring arm 31 parallel to shuttle 28, this distance is equal to the distance between extension nut 36 and shaft 32. Referring to FIG. 3*e*, at maximum airflow with spring arm 31 perpendicular to shuttle 28, the distance between extension nut 36 and hole 28*b* increases by the relocation distance between hole 28*b* and shaft 32.

Figure 3F:
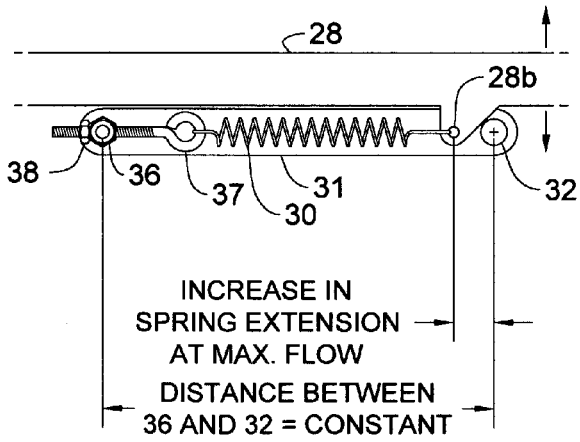
Figure 3G:
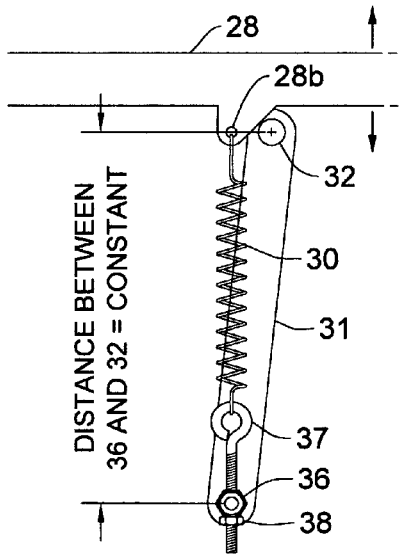

An alternate arrangement is shown in FIGS. 3*f* and 3*g*. Again, actuator shaft 32 is relocated away from hole 28*b* but parallel to shuttle 28 and away from shuttle pivot tabs 28*a* and the extended length of counterbalance spring 30 varies as the distance between extension nut 36 and hole 28*b*. Referring to FIG. 3*f*, at minimum airflow with spring arm 31 parallel to shuttle 28, this distance is equal to distance between extension nut 36 and shaft 32 minus the relocation distance of shaft 32. Referring to FIG. 3*g*, at maximum airflow with spring arm 31 perpendicular to shuttle 28, the spring 30 extends to the distance between extension nut 36 and shaft 32.

Returning to FIG. 4*b*, a guide angle 39 is fixedly attached to sidewall 12*a* by fasteners 58 and in which two arms 39*a* and 39*b* are formed. Guide angle arms 39*a* and 39*b* extend outwardly from sidewall 12*a* through opening 25*b* such that one arm is on each side of actuator shaft 32. An eccentric circular cam 40 is fixedly attached to spring arm 31 and actuator shaft 32. Eccentric cam 40 is made of a wear resistant—low friction material such as brass, nylon or ultra high molecular weight (UHMW) polypropylene, its diameter is equal to the distance between arms 39*a* and 39*b* and it rotates about its eccentric axis in a sliding fit between arms 39*a* and 39*b*. As spring arm 31 is rotated from its maximum setpoint position perpendicular to shuttle 28, to a position parallel to it, eccentric cam 40 pushes against arm 39*a* and, guided by tracks 24, slides chassis 25 and all the components that are attached to it in the downstream direction. Conversely, as spring arm 31 is rotated from its minimum setpoint position parallel to shuttle 28 to its maximum position perpendicular to it, eccentric cam 40 pushes against arm 39*b* and, guided by tracks 24, slides chassis 25 and all the components that are attached to it in the upstream direction.

A flywheel drive bow 43 is fixedly attached to shuttle 28 with fasteners 57. For clarity, drive bow 43 is shown attached to shuttle 28 at its distal end but could be attached at any convenient location along it. A tensioning spring 44 and a drive cable 45 are strung between the ends of drive bow 43 at two cable hooks 43*a*. Drive cable 45 is kept taut by tensioning spring 44. Drive cable 45 is flexible and is rolled one or more times around a drive bushing 46 as a string around a toy top. Drive bushing 46 is part of a dampener flywheel assembly 47. Cable hooks 43*a* are positioned at equal distances from the axis of pivot tabs 28*a*. The position of the axis of flywheel assembly 47 is such that drive cable 45 is substantially tangent to drive bushing 46 as drive bow 43 rotates about pivot tabs 28*a*.

FIG. 4*f* shows an exploded view and FIG. 4*g* shows a cross-sectional view of dampener flywheel assembly 47. It includes a flywheel shaft 55 with a tubular guide portion 55*a* and a flanged portion 55*b*. The following parts are inserted consecutively onto guide portion 55*a*:

(a) a flywheel disk 53 such that it rests against flanged portion 55*b* and rotates freely on guide portion 55*a*, (b) drive bushing 46 such that it slides against flywheel disk 53 and rotates freely on tubular guide portion 55*a*. Drive bushing 46 is made of a wear resistant elastomer material having a high coefficient of friction such as urethane or neoprene similar to stripper springs used in tool and die fabrication.

(c) a spring alignment shoulder washer 51 such that it rotates freely on guide portion 55*a*. Shoulder washer 51 is made of a wear resistant—low friction material such as brass, nylon or ultra high molecular weight (UHMW) polypropylene.

(d) a compression spring 52.

(e) a second spring alignment shoulder washer 51 such that it rotates freely on guide portion 55*a*.

A flywheel pivot pins 54 having a pointed conical ends 54*a* and a blunt end 54*b* is inserted into flanged portion 55*b* by its blunt end 54*b*. A retaining ring 50 is inserted with a friction fit onto the conical end 54*a* of a second pivot pin 54. The blunt extremity 54*b* of the second pivot pin 54 is slidably inserted into guide portion 55*a*. Retaining ring 50 comes to rest against shoulder washer 51, pushing it against spring 52 to compress it. In turn, drive bushing 46 is pushed against flywheel disk 53. The pressure applied by spring 52 is such that as drive bushing 46 is rotated, it will tend to rotate flywheel disk 53 due to the friction between them. As shown in the typical cross-section through dampener flywheel assembly 47 in FIG. 4*g*, it rotates freely on conical ends 54*a* of the two pivot pins 54 retained between two conical cup bearings 48. A conical recess 48*a* is formed in each conical cup bearings 48 to receive pivot pins 54. The angle of conical recess 48*a* is greater than the angle of pivot pin conical ends 54*a*. For convenience, the exterior of conical cup bearings 48 is threaded and they are fixedly attached to chassis 25 with a nut 49. The distance between the two conical cup bearings 48 is such that spring 52 is compressed, pushing flywheel pivot pins 54 into conical cup bearings 48 and eliminating all play.

Referring to FIG. 4*e*, an isometric view of an airflow setting quadrant assembly 60 is shown (not shown in FIG. 4*b*). It is situated on the exterior of chassis 25 and inserted onto actuator shaft 32. A flow indicator arm 61 with a pointed end 61*a* is fixedly attached to actuator shaft 32. Its angle of rotation is set by two "U" shaped adjustable limit stops 62 positioned on a slotted quadrant 63. Limit stops 62 are locked in place using a carriage bolt 64 and a wing nut 65. Slotted quadrant 63 is attached to chassis 25 by two fasteners 66. To provide accurate positioning of limit stops 62, a leg 62*a* is added to limit stop 62 and FIG. 4*h* shows the air volume regulator viewed from below with optional actuator 70 and airflow setting quadrant assembly 60 installed. FIG. 4*i* shows the air volume regulator viewed from below with only quadrant assembly 60 installed. In FIGS. 4*h* and 4*i*, a removable shroud 26 with an airtight seal at its perimeter 69 (shown in FIG. 4*b*) is attached over access opening 25*c* in chassis 25 (shown in FIG. 4*b*) using fasteners 27.

OPERATION—PREFERRED EMBODIMENT—FIGS. 5*a* to 5*e*

FIG. 5*a* shows a horizontal section through the air volume regulator as the air flows through it and set for its maximum flow rate. A pressure graph is laid out above it to illustrate the variations in pressures at various points as the air travels through the regulator where:

Point A is taken at the entrance to transition section 11,

Point B is taken at the entrance to the flow constricting section 12,

Point C is taken at the end of the curved portion of gates 15 and 16,

Point D is taken at the narrowest portion or throat,

Point E is taken at the exit of flow constricting section 12.

Point F is taken within outlet section 13.

Entering the regulator at inlet 10, the airflow passes from Point A to Point B, expanding in transition section 11 of included angle 11*a*. Transition section 11 advantageously increases the static pressure by converting a portion of the dynamic pressure to static pressure. The efficiency of the conversion is 67% or better if included angle 11*a* of transition section 11 is less than 45 degrees (as per the ASHREA—1989 Book of Fundamentals, page 32.30, table 4-5). The higher static pressure at Point B will be advantageously used to control the airflow as it enters flow constricting section 12. Two plenums 12*c* and 12*d* formed between gate 15 and sidewall 12*a*, and gate 16 and sidewall 12*b* respectively are pressurized to the same pressure as at Point B.

At Point B, airstream 17 begins to constrict and divide into two as it impinges on baffle 19 and rounded upstream ends 15*a* and 16*a* of gates 15 and 16 respectively. Gates 15 and 16 and the apex of baffle 19 form two venturi: two converging passageways, which at their narrowest, are the throat of the venturi. Between Points B and C, the following occurs:

(a) the air velocity and its associated dynamic pressure increase, (b) the total pressure remains substantially constant and (c) the static pressure decreases by substantially the same amount that the dynamic pressure increased.

Moving from Point B to Point D, the air velocity increases to the point where its associated dynamic pressure exceeds the total pressure. This generates a negative static pressure or light vacuum in the space between gates 15 and 16 and baffle 19. The maximum static pressure differential across gates 15 and 16 is at Point D and is equal to the static pressure in plenums 12*c* and 12*d* minus the static pressure at Point D. This is shown on the graph on FIG. 5*a* as being equal to ΔP. This pressure differential generates a force, which tends to urge gates 15 and 16 towards baffle 19 and restrict the airflow. Baffle 19 helps to lengthen the high velocity segment of the passageways and thus the zone of light vacuum. Ogival shaped baffle air guide 19*b* reduces the noise generated by the expanding air between Point D and Point E as it passes through openings 19*a* and converts a portion of the dynamic pressure back to static pressure as the air expands ("static regain").

Although the static pressure differential across gates 15 and 16 drops between Point D and Point E, it still contributes to urging them towards baffle 19 and restrict the airflow. The relatively large surfaces of gates 15 and 16 over which the above defined pressure differentials are applied generate sufficient forces to bring the airflow under control at pressures of 25 pascals (0.1" w.g.) or less throughout the full airflow range of the air volume regulator.

As the static pressure at inlet 10 increases beyond the 25 pascals (0.1" w.g.) threshold, the flow restricting force generated by the static pressure differential across gates 15 and 16 exceeds the equilibrating force of counterbalance spring 30. As cable cam 73*a* starts to move in the downstream direction, coupling cable 73 pulls shuttle 28 rotating it about its pivot tabs 28*a*. The force required to pull shuttle 28 and extend counterbalance spring 30 is at first very low due to the high angle of incidence of coupling cable 73 to the shuttle 28 (almost perpendicular—see FIG. 5*a*). As the pressure increases, the angle of incidence of coupling cable 73 decreases and the distance traveled by gate lever 18 reduces for an equal incremental pressure rise. At the maximum pressure, the angle of incidence of coupling cable 73 is less than 45° as is shown in FIG. 5*b*. The net effect is that for a linear increase in the pressure upstream, there is an exponential reduction in the travel of cable cam 73*a*.

Figure 1:
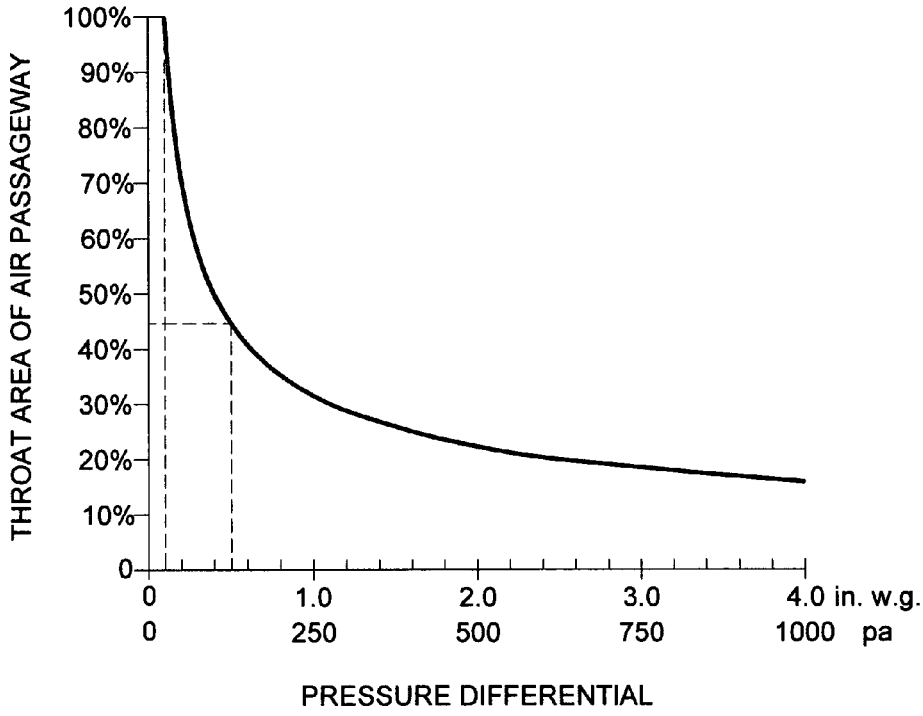
FIG. 1 shows a graph of the variation of the cross-sectional area of the throat of the airflow passageway versus the static pressure differential between the inlet and throat for a constant flow of air.

Referring back to FIG. 1, this is the desired exponential characteristic for the reduction of the throat of the venturi. Since the area of the air passageway is equal to the height of gates 15 and 16 times the throat width and that the gate height is fixed then the exponential equation for the passageway width is:

$$\text{Width} = \frac{\text{constant}}{\sqrt{\text{static pressure drop}}}$$

Moving to FIG. 5*c*, it shows a horizontal section through the air volume regulator at a reduce flow rate and minimum pressure. To reduce the flow rate, three adjustments are made:

(a) The initial width of the air passageway at points D (the venturi throat) is reduced proportional to the desired airflow reduction.

(b) The spring rate of counterbalance spring 30 is reduced proportional to the desired airflow reduction.

(c) The initial spring tension of counterbalance spring 30 is reduced proportional to the desired airflow reduction.

The initial reduction in the venturi throat defines the new starting point of the airflow control and the proportional reduction of the spring rate (softer spring) combined with the reduction of the spring initial tension, maintains the reduced airflow rate substantially constant as the pressure differential varies.

All the adjustments are made simultaneously by the rotation of actuator shaft 32. To reduce the initial throat width of the venturi proportional to the desired flow rate reduction, gates 15 and 16 are made to initiate their flow constricting function proportionally closer to baffle 19.

As actuator shaft 32 rotates:

(a) eccentric cam 40 rotates and pushes against guide angle arm 39*a*, (b) since guide angle 39 is fixedly mounted the sidewall 12*a*, circular cam 40 pushes chassis 25 with all the components mounted to it (and more specifically cable cam 73*b*) in the downstream direction guided by tracks 24, (c) since coupling cable 73 links gate lever 18 to shuttle 28, gate lever 18 also move in the downstream direction allowing the pressure differential across gates 15 and 16 to push them towards baffle 19.

As previously outlined in the discussion of prior art, the spring rate of counterbalance spring 30 must vary proportionally to the changes in air volume flow rate for the air volume flow rate to remain substantially constant as the pressure at the inlet to the regulator varies.

In referring to FIGS. 3*a*, 3*b* and 3*c*, the spring rate is defined as the "force-displacement" characteristic of a spring. A close approximation of the required variation of the spring rate is advantageously achieved by a simple mechanism that consists of:

(a) an output shuttle having a fixed linear trajectory to output the desired "force-displacement" characteristic, (b) a spring pivotably attached at on end to the shuttle and having a predetermined initial deflection and spring rate or "force-displacement" characteristic, (c) varying the angle of incidence of the spring to the shuttle trajectory.

While maintaining the shuttle's load displacement distance "D" constant in FIGS. 3*a*, 3*b* and 3*c* and referring more specifically to FIG. 3*a*, the in-line or parallel position is first analyzed:

the spring reaction force "R" equals the output force "F" ($R_i$=$F_i$ and $R_f$=$F_f$), the spring deflection "d" equals the load displacement "D" and the shuttle output "force-displacement characteristic" $K_{fd}$ equals the spring rate of the installed spring.

Moving to FIG. 3*b*, it shows the spring rotated to an angle of A degrees. The shuttle's output force and output "force-displacement characteristic" vary as follows:

the output force is given by:

$R_x$=spring load×cosine A=$R_f$×cosine A the spring load is equal to:

$R_f$=spring constant×d the spring deflection d is:

d=D×cosine A

Combining the three previous equations, the output force is equal to:

$$R_x = [\text{spring constant} \times (D \times \text{cosine } A)] \times \text{cosine } A$$
$$= \text{spring constant} \times D \times (\text{cosine } A)^2$$

the output "force-displacement characteristic" $K_{fd}$ is given by:

$$K_{fd} = \frac{R_x}{D} = \frac{\text{spring constant} \times D \times (\text{cosine } A)^2}{D}$$
$$= \text{spring constant} \times (\text{cosine } A)^2$$

Figure 2:
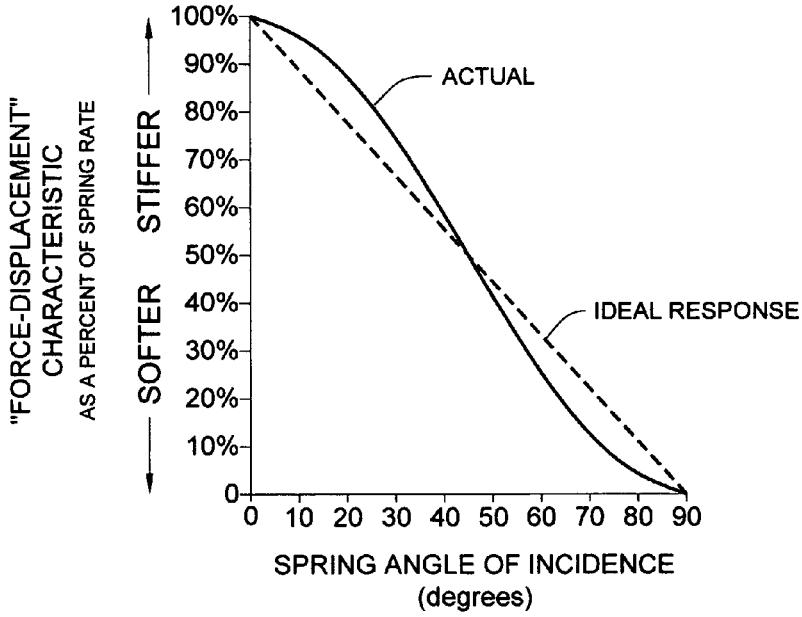
FIG. 2 shows a graph of the variation of the force-displacement characteristic versus the angle of incidence of the counterbalance spring as illustrated in FIG. 3*a* through 3*c*.

Thus for a given spring rate, the shuttle output "force-displacement characteristic" $K_{fd}$ varies as the square of the cosine of the spring angle. FIG. 2 shows a graphical representation of the above mechanism: the output "force-displacement characteristic" variation versus the angle of incidence of the spring. As a reference, the desired true linear or ideal variation of the output "force-displacement characteristic" is presented as a dashed line. Although the function $(\text{cosine A})^2$ is not a linear function, in practice, this mechanism adequately simulates the desired variation of the output's "force-displacement characteristic". The discrepancy between the ideal response and the actual variation is easily compensated for by adjusting scaled decal 67 to show the actual flow rate as a function of the counterbalance spring angle.

Returning now to FIG. 5*c*, in rotating actuator shaft 32 in a clockwise direction, spring arm 31 rotates counterbalance spring 30 around hole 28*b* and since the movement of shuttle 28 is limited by pivot tabs 28*a*, the "force-displacement characteristic" as seen by shuttle 28 varies in relation to the angle of rotation of actuator shaft 32. The tension of counterbalance spring 30 is also reduced as shown in FIG. 3*d* or 3*e* or a combination thereof. FIG. 5*d* shows the regulator under reduced flow and maximum pressure.

As outlined in the preferred embodiment, the axis of actuator shaft 32 is positioned as close as is practical to the counterbalance spring pivot axis at hole 28*b*. An advantage is sought from this proximal positioning: if counterbalance spring 30 and spring arm 31 aligned, counterbalance spring 30 will not tend to rotate spring arm 31 about actuator shaft 32 irregardless of the angular position of counterbalance spring 30 as it rotates about pivot hole 28*b*. As is shown in FIGS. 5*c*, 5*d* and 5*e*, some misalignment does occur between the counterbalance spring pivot axis at pivot hole 28*b* because its relative position to actuator shaft 32 varies as the pressure conditions change at inlet 10 of the regulator. The angular misalignment of counterbalance spring 30 and spring arm 31 is limited to around 10° by making spring arm 31 sufficiently long to achieve this limitation. This limits the torque generated by counterbalance spring 30 on actuator shaft 32.

FIG. 5*e* shows counterbalance spring 30 fully rotated by spring arm 31 to the minimum airflow position where counterbalance spring 30 lies on a imaginary line between shuttle pivot tabs 28*a* and pivot hole 28*b* (as per the condition in FIG. 3*c*); counterbalance spring 30 now generates no retaining force. It is to be noted that the angle of rotation of spring arm 31 has exceeded 90 degrees because of the displacement of shuttle 28. The two gates 15 and 16, under the action of the pressure differential across them, close against baffle 19 covering openings 19*a* and shutting off the airflow through the regulator. To achieve this, the rotation of eccentric circular cam 40 must slide chassis 25 a minimum distance in the downstream direction to allow cable cam 73*a* to swing freely until gates 15 and 16 close against V baffle 19: shuttle 28 swings towards sidewall opening 13*c* and coupling cable 73 is no longer under tension. The required travel of chassis 25 generated by the rotation of eccentric cam 40 is determined experimentally. It is proportional to the travel of cable cam 73*a*. As an example, for a 152 mm (6") diameter inlet 10, the travel of cable cam 73*a* is 54 mm (2.125") and the travel of chassis 25 is substantially equal to 13 mm (½") or approximately one quarter the travel of cable cam 73*a*.

Referring now to FIG. 4*e*, flow indicator arm 61 of quadrant assembly 60 limits or fixes the angular displacement of actuator shaft 32 to set the desired airflow rate(s). When the airflow set-point is variable, actuator 70 (shown in FIG. 4*h*) positions flow indicator arm 61 between two limit stops 62:

one for the maximum airflow, one for minimum airflow. When the airflow set-point is fixed, two limit stops 62 are pushed tight against both sides of indicator arm 61 to lock it in place. In conjunction with scaled decal 67 glued to chassis 25, indicator arm 61 permits a direct reading of the air volume being delivered through the airflow regulator in operation.

Referring now to FIGS. 4*f* and 4*g*, dampener flywheel assembly 47 is proposed to control the air volume regulator propensity to flutter, oscillate or pulsate under unstable airflow conditions at its inlet. As taught in prior art, a flywheel can be used to change the natural frequency of an oscillating mechanism. This in itself does not dampen the harmonic oscillation, reduce or stop it since no energy is dissipated; only its natural frequency is changed. Thus there exits a pressure pulse frequency at which the flywheel is of no use.

My proposed dampener flywheel assembly 47 is built as a "limited torque" drive. It adds dampening by permitting slippage under moderate to high accelerations or decelerations of the flywheel assembly 47 in the frequency range in which a flywheel alone is ineffective. Under normal operating conditions, flywheel assembly 47 rotates very slowly with substantially no friction as the air volume regulator reacts to slow changes in the pressure at its inlet.

If a pressure pulse attains the air volume regulator, the "limited torque" drive of dampener flywheel assembly 47 reacts to:

a) dissipate a portion of the energy as drive bushing 46 slips on flywheel disk 53, thus limiting the amount of energy which can be stored in flywheel assembly 47. This loss of energy dampens the pulsation, b) desynchronize flywheel assembly 47 from the air volume regulator making them out of phase, i.e. the inertia of flywheel assembly 47 will cause flywheel disk 53 to rotate in a clockwise direction and, because of the slippage, the air volume regulator can be rotating drive bushing 46 in a counterclockwise direction.

In practice, the mass and diameter of flywheel disk 53 is adjusted to reduce the natural frequency of the air volume regulator to less than ½ cycle per second. The maximum torque that can be applied to flywheel assembly 47 is limited by the force of compression spring 52 pushing drive bushing 46 against it and the friction coefficient between them. The load applied by compressing spring 52 is adjusted by increasing or reducing its deflection. This is achieved by moving internal tooth retaining rings 50 along flywheel pivot pins 54. The friction coefficient is fixed by the choice of materials to fabricate flywheel disk 53 (usually steel) and drive bushing 46. For drive bushing 46, the preferred material choice is an elastomer plastic such as neoprene or urethane that have the required high friction coefficient and a good wear resistance. Compression spring 52 has a dual function: the first one outlined above is to push drive bushing 46 and flywheel disk 53 together to increase friction between them; the second is to push flywheel pivot pins 54 into conical cup bearings 48, eliminating the need for adjustment between them.

DETAILLED DESCRIPTION—ADDITIONAL EMBODIMENTS—FIGS. 6*a*, 6*b*, 7*a*, 7*b*, 8*a*, 8*b* and 9

In FIGS. 6*a* and 6*b*, the elements of the flow control section are rearranged. Baffle 19 is separated into two along its axis of symmetry that runs through its apex. The first baffle half including baffle arm 19*d* and its associated half of curved baffle air guide 19*b* is then fixedly attached to sidewalls 12*b*. The second baffle half including baffle arm 19*e* and its associated half of curved baffle air guide 19*b* is then fixedly attached to sidewalls 12*a*. Gate 15 remains with baffle arm 19*d* and gate 16 remains with baffle arms 19*e*. Baffle arms 19*d* and 19*e* are then reassembled and sealed together at their downstream edges. The defining characteristics of baffle arms 19*d* and 19*e*, baffle openings 19*a* and the curvature of baffle air guides 19*b* remain the same as in the preferred embodiment. Drive pin 20 and its associated slot 21 are replaced. In their place, 4 links 18*a*, 18*b*, 18*c* and 18*d* are added such that gates 15 and 16 continue to move in unison and in opposite directions. Links 18*a*, 18*b*, 18*c* and 18*d* are pivotably attached to each other at their ends, to gate lever 18 and to gate brackets 15*d* and 16*d* with pivot screws 68. Gate lever 18 and link 18*d* are pivotably attached to sidewalls 13*a* and 13*b* respectively with additional pivot screws 68. The counterbalance section is the same as the preferred embodiment shown in FIG. 4*b*.

Now referring to FIG. 7*a* and FIG. 7*b*, two alternatives to coupling cable 73 with cable cams 73*a* and 73*b* are shown. In FIG. 7*a*, a coupling link 71 is shown pivotably attached by pivot screws 68 to gate lever 18 and shuttle 28. Coupling link 71 functions in a similar fashion to coupling cable 73. Referring to FIG. 7*b*, a second alternative is a cam/cam follower combination which gives similar load transmitting characteristics as coupling cable 73. A follower bearing 23 is attached to the distal end of gate lever 18. The relative position of follower bearing 23 is such that its axis of rotation and the pivot axes of gates 15 and 16 are substantially in the same plane when no pressurized air is supplied to the air volume regulator. As a result, when air begins to flow through the regulator, the direction of movement of follower bearing 23 is substantially linear, parallel to sidewall 13*a* and in the downstream direction. A concave circular cam 29 is fixedly attached to shuttle 28 with fasteners 56 such that follower bearing 23 is in rolling contact with the concave circular surface of cam 29. The radius of cam 29 is determined experimentally and is proportional to the maximum travel of follower bearing 23. As an example, for a 152 mm (6") diameter inlet 10, the travel of follower bearing 23 is 54 mm (2.125") and the radius is equal to 63 mm (2.5") with a 23 mm-0.905" diameter follower bearing 23 or substantially equal to 1.2 times the travel of follower bearing 23. Cam 29 is so oriented that when gate lever 18 and follower bearing 23 move in the downstream direction, follower-bearing 23 rotates cam 29 about pivot tabs 28*a* at right angle to the travel of follower bearing 23.

FIG. 8*a* shows the proposed adjustable counterbalance spring assembly and cable driven flywheel, as taught in the preferred embodiment, advantageously applied to a known air volume regulator design. Such prior art air volume regulator are shown in U.S. Pat. No. 3,942,552 to Logsdon (1976), U.S. Pat. No. 3,939,868 to Logsdon (1976), U.S. Pat. No. 3,425,443 to Smith (1969), U.S. Pat. No. 3,060,960 to Waterfill (1962), 2890,716 to Werder (1959) and my own Patent 4,130,132 (1978).

An airframe is formed by 2 impervious end walls 122, 2 impervious sidewalls 117, 2 pervious pitched sidewalls 116, an inlet opening 126 and a crown 112. Pervious walls 116 can be a perforating sheet, an assembly of rods or a screen material such that they permit the passage of air. An airstream 17 enters the airframe through opening 126 and exits through pervious sidewalls 116. The flow restricting gates take the form of two impervious flexible curtains 115 mounted to rigid curtain frames 114. Curtain frames 114 are pivotably attached by pivot arms 114*e* to end walls 122 near crow 112 with pivot pins 113. Curtains 115 are fixedly secured to curtain frames 114 at their distal upstream edges 114*d* and are fixedly attached to the air frame at crown 112.

Dampener flywheel assembly 47 is positioned upstream in airstream 17 between curtain frames 114 and walls 122. Dampener flywheel assembly 47 is substantially the same as shown in FIGS. 5*a* and 5*b* of the preferred embodiment. In FIG. 8*a,* cup bearings 49 (not shown) are mounted in end walls 122 such that they are centered between both sidewalls 117. To restrain curtains 115 and they supporting curtain frames 114, an equalizer cable 118 is fixedly attached to both curtain frames 114 at 114*c*. A shuttle 111 movably connects equalizer cable 118 at its center to a counterbalance spring 30. A shuttle hook 111*b* having a circular convex surface is required to preclude the premature failure of cable 118 from flexural fatigue as it flexes at its center. A convex surface is also provided on frames 114 at 114*f* to again preclude cable 118 from breaking by flexural fatigue at its pivot points.

The opposite end of tension link 111 is pivotably attached to the end-loop of a counterbalance spring 30 by pivot hole 111*a*. A mounting plate 123 is fixedly attached perpendicular to crow 112 and parallel to end wall 122. A retaining arm 110 is pivotably attached at one end to mounting plate 123 with pivot pin 110*a*. The distal end of retaining arm 110 is pivotably inserted onto the end-loop of counterbalance spring 30 at pivot hole 110*b*. Retaining arm 110 retains tension link 111 so that it moves in a direction substantially perpendicular to crown 112.

A low friction sleeve bearing 33 is fixedly moounted through mounting plate 123 such that its axis of rotation is parallel to crown 112 and intersects the centerline of tension link 111. Some experimental fine tuning is required in determining the precise distance of the axis of sleeve bearing 33 from crown 112. Its axis of rotation is above the collinear axes of pivot holes 110*b* and 111*a* when the airflow regulator is not in operation. As with the preferred embodiment, an actuator shaft 32 with a spring arm 31 fixedly mounted to its end is inserted into sleeve 33 to freely rotate. An optional actuator 70 (not shown) of know construction or airflow setting quadrant assembly 60 (as shown in FIG. 4*e*) or both can be mounted to the opposite end of actuator shaft 32 to position spring arm 31 and set the flow rate. The following parts are attached to spring arm 31 in the same way as with the preferred embodiment: a threaded pivot bolt 34 (not shown), a locking nut 35 (not shown), an extension nut 36, an threaded eye bolt 37 and an adjusting nut 38.

With one end of counterbalance spring 30 mounted in pivot holes 110*b* and 111*a* as outlined above, its opposite end is inserted in the eye of eye bolt 37. A scaled air volume decal 67 is fixedly attached to mounting plate 123 to permit a direct reading of the airflow set point.

Now referring to FIGS. 8*a,* 8*b* and 8*c,* a novel method of maintaining the synchronized operation of the pair of curtain frames 114 is shown. Using 2 drive cables 124*a* and 124*b,* this method makes curtain frames 114 move in unison and in opposite directions and also drives dampener flywheel assembly 47. Two drive bows 119 and 120 are pivotably fixed near the upstream ends of curtain frames 114 at 114*a* and 114*b* respectively. A tensioning link 121 is pivotably attached to the distal end of drive box 120 at 120*a*. As shown in FIG. 8*b,* drive cable 124*a* is strung from drive bow 120 at 120*b,* around drive bushing 46, to drive box 119 at 119*a*. As shown in FIG. 8*c,* the second drive cable 124*b* is strung from drive bow 119 at 119*b,* around drive bushing 46, to tensioning link 121 at 121*a*. For practical reasons, the geometry of drive bows 119 and 120 is such that drive cables 124*a* and 124*b* are made the same length. To complete the assembly, one end of a tensioning spring 125 is hooked to drive bow 120 at 120*c* and its distal end is hooked on tensioning link 121 at 121*b*. This keeps drive cable 124*b* taut. Because drive cable 124*a* is attached to both drive bows, tensioning spring 125 also keeps drive cable 124*a* taut.

An alternate to eccentric cam 40 and its associated guide angle 39 is shown in FIG. 9. A connecting link 41 is pivotably attached at both ends by two pivot screws 68, one end to spring arm 31 and the other to a retaining angle 42. Retaining angle 42 is fixedly attached to sidewall 12*a* by fasteners 58 and extends through opening 25*b* out passed actuator shaft 32. As spring arm 31 is rotated, connecting link 41 pulls or pushes chassis 25 and all the components that are attached to it, such that the desired relationship between the travel of chassis 25 and the rotation of spring arm 31 is maintained as per the preferred embodiment.

OPERATION—ADDITIONAL EMBODIMENTS—FIGS. 6*b,* 7*a,* 7*b,* 8*a,* 8*b* and 9

Referring to FIG. 6*b,* an additional advantage is gained from modifying the arrangement of V baffle 19 and gates 15 and 16. Placing gates 15 and 16 in the center of airstream 17, the pressure which tends to push them towards baffle 19 is increased by the dynamic pressure of the airstream at their upstream ends 15*a* and 16*a* as airstream 17*d* enters the space between them. Since the airflow is maintained constant through an air volume regulator so is the dynamic pressure and the net pressure increase remains constant as the static pressure at the inlet varies. Thus no adjustments are required in the response characteristics of the linkage and counterbalance spring 30 is selected slightly stiffer. This increase can be substantial at high inlet velocities (at maximum airflow capacity) but is of limited effect at low inlet velocities (at minimum airflow capacity). This makes the regulator minimum static pressure at maximum airflow capacity less than the minimum static pressure at minimum airflow capacity. This situation is the inverse of what is normally seen in airflow regulators. Tests have shown that values of the regulator minimum static pressure at maximum airflow capacity can approach zero. Thus, with these conditions, the sum of the pressure regain generated by transition section 11 and the dynamic pressure entering the space between gates 15 and 16 can be sufficient to initiate airflow control of the airflow regulator and maintain a substantially constant flow of air through it.

Now referring to FIG. 7*a* and FIG. 7*b,* alternatives to coupling cable 73 with cable cams 73*a* are shown. Coupling link 71 and follower bearing 23 with cam 29 generate the same "force-displacement" characteristic between gate lever 18 and shuttle 28 as compared to the use of coupling cable 73 with cable cams 73*a*.

Referring to FIGS. 4*f* and 4*g* of the preferred embodiment, the torque driving flywheel assembly 47 is adjusted by increasing or reducing the slippage between drive bushing 46 on flywheel disk 53. The slippage is controlled by adjusting the deflection of compression spring 52. An alternate means of limiting the torque delivered to flywheel disk 53 is to fix drive bushing 46 to flywheel disk 53 and adjust the tension of drive cable tensioning spring 44. This will allow some slippage of drive cables 45 on drive bushing 46. The net effect will be the same: if the torque delivered by drive cable 45 exceeds a given amount, it will slip and dissipate a portion of the energy. Drive cable 45 can be coated with a wear resistant material such as nylon. Also, drive bushing 46 can be made of a wear resistant material such as nylon, brass or ultra high molecular weight (UHMW) polypropylene. Optionally, internal tooth retaining ring 50, spring alignment shoulder washer 51 and compression spring 52 could still be used to eliminate the play between pivot pins 54 and conical cup bearings 48. In this alternate method, no change in performance is seen as compared to dampener flywheel assembly 47 of the preferred embodiment.

Referring to FIGS. 8*a*, 8*b* and 8*c*, the application of the adjustable counterbalance spring assembly, as taught in the preferred embodiment, solves a long felt need: a simple means to adjust the spring rate of the counterbalance spring. Numerous attempts have been made over time to create a low cost and efficient adjustable spring rate mechanism as proven by the numerous U.S. Pat. Nos.: 3,942,552 to Logsdon (1976), 3,939,868 Logsdon (1976), 3,425,443 to Smith (1969), 3,060,960 to Waterfill (1962), 2890,716 to Werder (1959) or my own Patent 4,130,132 (1978).

The "limited torque" cable driven flywheel also has several major advantages:

(a) Less moving parts reduces the associated friction, which allows the air volume regulator to initiate and maintain control of the airflow using less pressure. The air volume regulator minimum static pressure is advantageously reduced.

(b) The use of a cable rather than a linkage and pivot screws also reduces the friction by eliminating sliding surfaces inherent to pivot pins or pivot screws.

(c) The "limited torque" characteristic of proposed dampener flywheel assembly 47 adds the required energy dissipation to the dampening the airflow induced oscillations of the air volume regulator without hindering its flow tracking characteristic.

CONCLUSION, RAMIFICATIONS AND SCOPE OF THE INVENTION

Accordingly, the reader will see that the "airflow powered" air volume regulator of this invention reliably regulates the flow of air passing through it at pressures of 25 pascals (0.1" w.g.) or less and this while respecting the industry standard variation of +/−5%. In addition, it will do this over a wide airflow range without having to change or manually adjust the installed counterbalance spring. With the use of the optional actuator, the airflow can be shut-off (zero flow) if desired. When pneumatic actuators are selected, they will not "slide" the airflow set point as the pressure in the ductwork system varies. With the control mechanism situated outside of the airstream, it is not affected by the accumulation of airborne particles on the moving parts. The propensity to pulsate is controlled with the use of the "limited torque" drive flywheel. Furthermore, once installed in the ductwork system, its airflow set point is fully adjustable over the airflow range without having to open access panels or the use of any tools. Adding an optional actuator is simple and easily done without affecting the calibration of the unit or having to open access panels. The minimum and maximum airflow rates are easily adjustable at any time, again without affecting the calibration of the unit, having to open access panels or the use of any tools.

While may above description contains many specificities, these should not be construed as limitations on the scope of the invention, but rather as an exemplification of a preferred and alternate embodiments thereof. Other variations are possible.

Accordingly, the scope of this invention should be determined not by the embodiments illustrated, but by the appended claims and their legal equivalents.

That which is claimed is:

1. A volume flow regulator as used in air conditioning and ventilating systems to maintain a substantially constant volumetric airflow rate in response to fluctuations of upstream air pressure supplied to said volume flow regulator, comprising:

(a) a duct forming a rectangular passageway for a flow of air supplied thereto, said flow of air entering said duct at an upstream end and leaving said duct at a downstream end, said duct having 2 opposing sidewalls, a top and a bottom, (b) a V shaped baffle extending the full height of said duct, having (i) an apex positioned in the middle of said upstream end and parallel to said sidewalls, thereby dividing said flow of air into two airstreams, (ii) two substantially flat elongated baffle arms extending downstream from said apex to said sidewalls at said downstream end, said baffle arms being fixedly sealed to said duct and each of said baffle arms having an opening cut within to allow the passage of said airstreams therethrough, (iii) a baffle air guide between said baffle arms extending from the upstream edge of said baffle arm openings towards the middle of said downstream end to reunite and diffuse confluent said airstreams after said airstreams pass through said baffle arm openings, (c) a pair of gates being substantially flat and elongated inserted on each side of said V baffle between said sidewalls and said baffle arms forming two passageways between said gates and said baffle arms, each of said gates extending upstream from the intersection of said baffle arms and said sidewalls to said apex, each of said gates having (i) an upstream edge curved away from said V baffle to guide said flow of air between said gates and said baffle arms, (ii) a substantially flat surface exposed to said airstreams and (iii) a downstream edge being pivotably attached to its adjacent said baffle arm, whereby said flow of air urges said gates towards said baffle arms generating a gate load with an exponential force-displacement characteristic and, if said gate load is not resisted, said gates close said baffle arm openings shutting off said flow of air, whereby said passageways are streamlined to offer the minimum resistance to the free passage of said flow of air, whereby said passageways form venturis with the passage of said flow of air, generating a light vacuum between said gates and said baffle arms, (d) a gate coupling means interconnecting said gates for effective unison movement thereof towards and away from said baffle arms and having of a single central coupler, (e) a counterbalance means articulately connected to said gates to resist said gate load whereby the volumetric flow rate of said flow of air remains substantially constant as said gates respond to said fluctuations in upstream air pressure, and can be changed to a predetermined flow rate, as desired, said predetermined flow rate also remaining substantially constant as said gates again respond to fluctuations in said upstream air pressure, whereby said volume flow regulator will not flutter, oscillate nor pulsate and this, more specifically, when said fluctuations of upstream air pressure become cyclic with a predominant pulsation frequency.

2. The volume flow regulator of claim 1 wherein said counterbalance means comprises:

(a) a counterbalance spring having (i) a linear force-displacement characteristic, (ii) an initial deflection length which generates an initial spring bias substantially proportional thereto, (iii) a first and a second load point at the extremities thereof by which loads may be applied and transmitted, (b) a shuttle with a guided path limited to a bi-directional movement along a substantially linear trajectory, having a spring pivot means to which said counterbalance spring's first loading point is pivotably attached and such that said counterbalance spring can be adjustably positioned radially about said spring pivot means from a position parallel to said shuttle's guided path to a position perpendicular to said shuttle's guided path, whereby the combination of said counterbalance spring with said shuttle conveys an linear force-displacement characteristic to said shuttle, whereby for each radial position of said counterbalance spring, said shuttle inherits a distinct linear force-displacement characteristic, whereby said predetermined flow rate can be changed to a new flow rate by radially repositioning said counterbalance spring until said new flow rate is obtained and once obtained, said new flow rate remains substantially constant as said gates respond to fluctuations in said upstream air pressure, (c) a gate lever fixedly attached to one of said gates and extending away from the pivoted said downstream edge thereof to a distal end, (d) a linearizing means to convert said gate's exponential force-displacement characteristic to a linear force-displacement characteristic compatible with said counterbalance spring, said linearizing means linking said distal end of gate level to said shuttle. Said linearizing means having:

(i) a first link point positioned on said distal end of gate lever, said first link point having a bi-directional guided path along a substantially linear trajectory, and (ii) a second link point positioned on said shuttle, said second link point having a bi-directional guided path along a substantially linear trajectory parallel to said shuttle's guided path, and said shuttle being positioned such that said first link point's guided path is substantially perpendicular to said second link point's guided path when said gates are swung open against said sidewalls, (iii) a linking means pivotably connecting said first link point to said second link point, whereby said linking means transmits said gate load to said shuttle and in so doing, converts said gate's exponential force-displacement characteristic to said shuttle's linear force-displacement characteristic, whereby the interconnection of said counterbalance spring with said shuttle and said gates form a flow control group having a natural vibration frequency, (e) a dampening means to effectively dampen resonance when said predominant pulsation frequency of said fluctuations of upstream air pressure is substantially the same as said natural vibration frequency of said flow control group.

3. The volume flow regulator of claim 2 wherein said linking means is a flexible coupling cable.

4. The volume flow regulator of claim 2, further including a spring positioning means for adjustably orienting said counterbalance spring in relation to said shuttle's guided path while maintaining said counterbalance spring's initial deflection length, and defining an angle of incidence of said counterbalance spring to said shuttle's guided path whereby said shuttle's linear force-displacement characteristic is equal to said counterbalance spring's force-displacement characteristic when said counterbalance spring is parallel to said shuttle's guided path, null when perpendicular thereto and substantially proportional to said angle of incidence when positioned between parallel and perpendicular thereto.

5. The volume flow regulator of claim 4, wherein said spring positioning means comprises (a) a actuator shaft having (i) a shaft guiding means fixedly attached to said volume flow regulator and in which said actuator shaft is free to rotate, (ii) an angle of rotation substantially equal to 90 degrees and (iii) an axis of rotation substantially coaxial to the axis of said spring pivot means on said shuttle, (b) a pivoting spring arm having (i) a distal end to which said counterbalance spring's second loading point is pivotably attached and (ii) a proximal end fixedly attached to one end of said actuator shaft whereby the rotation of said spring arm varies said angle of incidence between parallel and perpendicular and said counterbalance spring's initial deflection length remains substantially unchanged, whereby said shuttle's load-displacement characteristic is substantially proportional to said angle of incidence, whereby said actuator shaft can be positioned at a predetermined angle of incidence with an actuator of know construction, whereby, as desired, said initial deflection length can be varied by a predetermined variation and this, by moving said actuator shaft laterally such that said axis of rotation thereof is repositioned parallel to said pivot means axis, the distance between said actuator shaft axis and said pivot means axis being equal to said predetermined variation.

6. The volume flow regulator of claim 2, wherein said dampening means comprises:

(a) a flywheel having an axis of rotation perpendicular to said shuttle's guided path and a predetermined inertia, (b) a flywheel shaft coaxial to said flywheel and pivotably mounted at both ends thereof to said volume flow regulator such that said flywheel shaft can freely rotate, (c) a torque limiter means being coaxial to said flywheel and said flywheel shaft, and friction-coupled with said flywheel such as to limit the amount of torque that can be transmitted to said flywheel to a predetermined amount and whereby said torque limiter means slips against said flywheel and generates frictional energy loses when said predetermined amount of torque is exceeded, (d) a cable bow having a cable hook at both ends thereof and fixedly mounted to said shuttle such that when a line is drawn between said cable hooks, said line is substantially parallel to said shuttle's guided path, (e) a drive cable wound around said torque limiter at least once and strung between said cable hooks forming a straight line there between and whereby a movement of said shuttle urges said flywheel to spin, whereby the synergy of the coupling of said flywheel's predetermined inertia to said flow control group by said torque limiter dampens possible resonance of said flow control group by lowering said natural vibration frequency of said flow control group, desynchronizing cycling of said flow control group from said cyclic fluctuations of upstream air pressure and adding dampening friction when said torque limiter slips against said flywheel.

7. A volume flow regulator as used in air conditioning and ventilating systems to maintain a substantially constant volumetric airflow rate in response to fluctuations of upstream air pressure supplied to said volume flow regulator, comprising:

(a) a duct forming a rectangular passageway for a flow of air supplied thereto, said flow of air entering said duct at an upstream end and leaving said duct at a downstream end, said duct having 2 opposing sidewalls, a top and a bottom (b) a V shaped baffle extending the full height of said duct, having (i) an apex positioned in the middle of said downstream end and parallel to said sidewalls, (ii) two substantially flat elongated arms extending upstream from said apex to said sidewalls at said upstream end, said baffle arms being fixedly sealed to said duct and each of said baffle arms having an opening cut within to allow the passage of said flow of air therethrough thereby dividing said flow of air into two airstreams, (iii) two baffle air guides extending from the upstream edge of said baffle arm openings towards said sidewalls at said downstream end to efficiently reunite and diffuse confluent said airstreams after they pass through said baffle arm openings, (c) a pair of gates being substantially flat and elongated inserted back to back between said baffle arms, each of said gates extending upstream from said apex to said upstream end of said baffle arms forming two passageways between said gates and said baffle arms, each of said gates having (i) an upstream edge curved towards the center of said duct to divide and guide said flow of air around said gates and towards said baffle arms, (ii) a substantially flat surface exposed to said flow of air and (iii) a downstream edge being pivotably attached to its adjacent said baffle arm, whereby said flow of air urges said gates towards said baffle arms generating a gate load with an exponential force-displacement characteristic and, if said gate load is not resisted, said gates close said baffle arm openings shutting off said flow of air, whereby said passageways are streamlined to offer the minimum resistance to the free passage of said flow of air, whereby said passageways form venturis with the passage of said flow of air, generating a light vacuum between said gates and said baffle arms, (d) a gate linkage means having a gate level with proximal and distal ends, said gate lever being pivotably attached by said proximal end thereof to one of said sidewalls, said gate linkage means interconnecting said gates for effective unison movement thereof towards and away from said baffle arms, and transmitting said gate load to said gate lever, (e) a counterbalance means articulately connected to the distal end of said gate lever to resist said gate load, whereby the volumetric flow rate of said flow of air remains substantially constant as said gates respond to said fluctuations in upstream air pressure, and can be changed to a predetermined flow rate, as desired, said predetermined flow rate also remaining substantially constant as said gates again respond to said fluctuations in upstream air pressure, whereby said volume flow regulator will not flutter, oscillate nor pulsate and this, more specifically, when said fluctuations of upstream air pressure become cyclic with a predominant pulsation frequency.

8. The volume flow regulator of claim 7 wherein said counterbalance means comprises:

(a) a counterbalance spring having (i) a linear force-displacement characteristic, (ii) an initial length which generates an initial spring bias proportional thereto, (iii) a first and a second load point at the extremities thereof by which loads may be applied and transmitted, (b) a shuttle with a guided path limited to a bi-directional movement along a substantially linear trajectory, having a spring pivot means to which said counterbalance spring's first loading point is pivotably attached and such that said counterbalance spring can be adjustably positioned radially about said spring pivot means from a position parallel to said shuttle's guided path to a position perpendicular to said shuttle's guided path, whereby the combination of said counterbalance spring with said shuttle conveys an linear force-displacement characteristic to said shuttle, whereby for each radial position of said counterbalance spring, said shuttle inherits a distinct linear force-displacement characteristic, whereby said predetermined flow rate can be changed to a new flow rate by radially repositioning said counterbalance spring until said new flow rate is obtained and once obtained, said new flow rate remains substantially constant as said gates respond to fluctuations in said upstream air pressure (c) a linearizing means to convert said gate's exponential force-displacement characteristic to a linear force-displacement characteristic compatible with said counterbalance spring, said linearizing means linking said distal end of gate lever to said shuttle. Said linearing means comprises:

(i) a first link point positioned on said distal end of gate lever, said first link point having a bi-directional guided path along a substantially linear trajectory, and (ii) a second link point positioned on said shuttle, said second link point having a bi-directional guided path along a substantially linear trajectory parallel to said shuttle's guided path, and said shuttle being positioned such that said first link point's guided path is substantially perpendicular to said second link point's guided path when said gates are swung open against said sidewalls, (iii) a linking means pivotably connecting said first link point to said second link point, whereby said linking means transmits said gate load to said shuttle and in so doing, converts said gate's exponential force-displacement characteristic to said shuttle's linear force-displacement characteristic, (d) a dampening means to effectively dampen resonance when said predominant pulsation frequency of said fluctuations of upstream air pressure is substantially the same as said natural vibration frequency of said flow control group.

9. The volume flow regulator of claim 8 wherein said linking means is a flexible coupling cable.

10. The volume flow regulator of claim 8, further including a spring positioning means for adjustably orienting said counterbalance spring in relation to said shuttle's guided path while maintaining said counterbalance spring's initial deflection length, and defining an angle of incidence of said counterbalance spring to said shuttle's guided path whereby said shuttle's linear force-displacement characteristic is equal to said counterbalance spring's force-displacement characteristic when said counterbalance spring is parallel to said shuttle's guided path, null when perpendicular thereto and substantially proportional to said angle of incidence when positioned between parallel and perpendicular thereto.

11. The volume flow regulator of claim 10, wherein said spring positioning means comprises (a) a actuator shaft having (i) a shaft guiding means fixedly attached to said volume flow regulator and in which said actuator shaft is free to rotate, (ii) an angle of rotation substantially equal to 90 degrees and (iii) an axis of rotation substantially coaxial to the axis of said spring pivot means on said shuttle, (b) a pivoting spring arm having (i) a distal end to which said counterbalance spring's second loading point is pivotably attached and (ii) a proximal end fixedly attached to one end of said actuator shaft whereby the rotation of said spring arm varies said angle of incidence between parallel and perpendicular and said counterbalance spring's initial deflection length remains substantially unchanged, whereby said shuttle's load-displacement characteristic is substantially proportional to said angle of incidence, whereby said actuator shaft can be positioned at a predetermined angle of incidence with an actuator of know construction, whereby, as desired, said initial deflection length can be varied by a predetermined variation and this, by moving said actuator shaft laterally such that said axis of rotation thereof is repositioned parallel to said pivot means axis, the distance between said actuator shaft axis and said pivot means axis being equal to said predetermined variation.

12. The volume flow regulator of claim 8, wherein said dampening means comprises:

(a) a flywheel having an axis of rotation perpendicular to said shuttle's guided path and a predetermined inertia, (b) a flywheel shaft coaxial to said flywheel and pivotably mounted at both ends thereof to said volume flow regulator such that said flywheel shaft can freely rotate, (c) a torque limiter means being coaxial to said flywheel and said flywheel shaft, and friction-coupled with said flywheel such as to limit the amount of torque that can be transmitted to said flywheel to a predetermined amount and whereby said torque limiter means slips against said flywheel and generates frictional energy loses when said predetermined amount of torque is exceeded, (d) a cable bow having a cable hook at both ends thereof and fixedly mounted to said shuttle such that when a line is drawn between said cable hooks, said line is substantially parallel to said shuttle's guided path, (e) a drive cable wound around said torque limiter at least once and strung between said cable hooks forming a straight line there between and whereby a movement of said shuttle urges said flywheel to spin, whereby the synergy of the coupling of said flywheel's predetermined inertia to said flow control group by said torque limiter dampens possible resonance of said flow control group by lowering said natural vibration frequency of said flow control group, desynchronizing cycling of said flow control group from said cyclic fluctuations of upstream air pressure and adding dampening friction when said torque limiter slips against said flywheel.

* * * * *